US008947406B2

(12) United States Patent
Wakimoto et al.

(10) Patent No.: US 8,947,406 B2
(45) Date of Patent: Feb. 3, 2015

(54) DISPLAY METHOD OF DISPLAY DEVICE

(75) Inventors: Kenichi Wakimoto, Kanagawa (JP); Masahiko Hayakawa, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 723 days.

(21) Appl. No.: 13/008,233

(22) Filed: Jan. 18, 2011

(65) Prior Publication Data

US 2011/0181802 A1 Jul. 28, 2011

(30) Foreign Application Priority Data

Jan. 20, 2010 (JP) ..... 2010-010186

(51) Int. Cl.
*G09G 5/00* (2006.01)
*G09G 3/36* (2006.01)

(52) U.S. Cl.
CPC ..... *G09G 3/3648* (2013.01); *G09G 3/3655* (2013.01); *G09G 2320/10* (2013.01); *G09G 2330/021* (2013.01); *G09G 2340/02* (2013.01); *G09G 2340/0435* (2013.01)
USPC ..... 345/204; 345/87; 345/92; 349/42

(58) Field of Classification Search
CPC ..... G09G 3/36; G09G 2320/10; G09G 2330/021; G09G 2340/02; G09G 2340/0435; G09G 3/3648
USPC ..... 345/87–99, 204–214; 349/42–47
See application file for complete search history.

(56) References Cited

U.S. PATENT DOCUMENTS

| | | | |
|---|---|---|---|
| 5,731,856 | A | 3/1998 | Kim et al. |
| 5,744,864 | A | 4/1998 | Cillessen et al. |
| 6,294,274 | B1 | 9/2001 | Kawazoe et al. |
| 6,563,174 | B2 | 5/2003 | Kawasaki et al. |
| 6,727,522 | B1 | 4/2004 | Kawasaki et al. |
| 7,049,190 | B2 | 5/2006 | Takeda et al. |
| 7,061,014 | B2 | 6/2006 | Hosono et al. |
| 7,064,346 | B2 | 6/2006 | Kawasaki et al. |

(Continued)

FOREIGN PATENT DOCUMENTS

| | | | |
|---|---|---|---|
| CN | 101047814 | A | 10/2007 |
| EP | 1296174 | A | 3/2003 |

(Continued)

OTHER PUBLICATIONS

Asakuma, N et al., "Crystallization and Reduction of Sol-Gel-Derived Zinc Oxide Films by Irradiation With Ultraviolet Lamp," Journal of Sol-Gel Science and Technology, 2003, vol. 26, pp. 181-184.

(Continued)

*Primary Examiner* — Hong Zhou
(74) *Attorney, Agent, or Firm* — Fish & Richardson P.C.

(57) ABSTRACT

A display method suitable for an image provided by a digital data file and/or a display method of a display device in which the image quality and power consumption are adjusted in accordance with the state of the display device or at user's request to display an image. The image is displayed on the display device in which a plurality of pixels having a pixel electrode connected to a switching element whose off-state current is reduced, using the image provided by the digital data file and data which is provided by the digital data file and is correlated to an operation of the display device.

9 Claims, 10 Drawing Sheets

(56) References Cited

U.S. PATENT DOCUMENTS

| | | | | |
|---|---|---|---|---|
| 7,105,868 | B2 | 9/2006 | Nause et al. | |
| 7,211,825 | B2 | 5/2007 | Shih et al | |
| 7,282,782 | B2 | 10/2007 | Hoffman et al. | |
| 7,286,108 | B2 | 10/2007 | Tsuda et al. | |
| 7,297,977 | B2 | 11/2007 | Hoffman et al. | |
| 7,321,353 | B2 | 1/2008 | Tsuda et al. | |
| 7,323,356 | B2 | 1/2008 | Hosono et al. | |
| 7,385,224 | B2 | 6/2008 | Ishii et al. | |
| 7,402,506 | B2 | 7/2008 | Levy et al. | |
| 7,411,209 | B2 | 8/2008 | Endo et al. | |
| 7,453,065 | B2 | 11/2008 | Saito et al. | |
| 7,453,087 | B2 | 11/2008 | Iwasaki | |
| 7,462,862 | B2 | 12/2008 | Hoffman et al. | |
| 7,468,304 | B2 | 12/2008 | Kaji et al. | |
| 7,501,293 | B2 | 3/2009 | Ito et al. | |
| 7,674,650 | B2 | 3/2010 | Akimoto et al. | |
| 7,732,819 | B2 | 6/2010 | Akimoto et al. | |
| 7,791,072 | B2 | 9/2010 | Kumomi et al. | |
| 7,924,276 | B2 | 4/2011 | Tsuda et al. | |
| 8,432,502 | B2 | 4/2013 | Yamazaki et al. | |
| 2001/0046027 | A1 | 11/2001 | Tai et al. | |
| 2002/0056838 | A1 | 5/2002 | Ogawa | |
| 2002/0061142 | A1* | 5/2002 | Hiramatsu | 382/254 |
| 2002/0132454 | A1 | 9/2002 | Ohtsu et al. | |
| 2003/0046662 | A1* | 3/2003 | Matsunaga | 717/115 |
| 2003/0189401 | A1 | 10/2003 | Kido et al. | |
| 2003/0218222 | A1 | 11/2003 | Wager, III et al. | |
| 2004/0038446 | A1 | 2/2004 | Takeda et al. | |
| 2004/0127038 | A1 | 7/2004 | Carcia et al. | |
| 2004/0145541 | A1* | 7/2004 | Iki et al. | 345/44 |
| 2005/0017302 | A1 | 1/2005 | Hoffman | |
| 2005/0199959 | A1 | 9/2005 | Chiang et al. | |
| 2006/0035452 | A1 | 2/2006 | Carcia et al. | |
| 2006/0043377 | A1 | 3/2006 | Hoffman et al. | |
| 2006/0091793 | A1 | 5/2006 | Baude et al. | |
| 2006/0108529 | A1 | 5/2006 | Saito et al. | |
| 2006/0108636 | A1 | 5/2006 | Sano et al. | |
| 2006/0110867 | A1 | 5/2006 | Yabuta et al. | |
| 2006/0113536 | A1 | 6/2006 | Kumomi et al. | |
| 2006/0113539 | A1 | 6/2006 | Sano et al. | |
| 2006/0113549 | A1 | 6/2006 | Den et al. | |
| 2006/0113565 | A1 | 6/2006 | Abe et al. | |
| 2006/0169973 | A1 | 8/2006 | Isa et al. | |
| 2006/0170111 | A1 | 8/2006 | Isa et al. | |
| 2006/0197092 | A1 | 9/2006 | Hoffman et al. | |
| 2006/0208977 | A1 | 9/2006 | Kimura | |
| 2006/0228974 | A1 | 10/2006 | Thelss et al. | |
| 2006/0231882 | A1 | 10/2006 | Kim et al. | |
| 2006/0238135 | A1 | 10/2006 | Kimura | |
| 2006/0244107 | A1 | 11/2006 | Sugihara et al. | |
| 2006/0284171 | A1 | 12/2006 | Levy et al. | |
| 2006/0284172 | A1 | 12/2006 | Ishii | |
| 2006/0292777 | A1 | 12/2006 | Dunbar | |
| 2007/0024187 | A1 | 2/2007 | Shin et al. | |
| 2007/0046191 | A1 | 3/2007 | Saito | |
| 2007/0052025 | A1 | 3/2007 | Yabuta | |
| 2007/0054507 | A1 | 3/2007 | Kaji et al. | |
| 2007/0057933 | A1* | 3/2007 | Ohno et al. | 345/204 |
| 2007/0090365 | A1 | 4/2007 | Hayashi et al. | |
| 2007/0108446 | A1 | 5/2007 | Akimoto | |
| 2007/0152217 | A1 | 7/2007 | Lai et al. | |
| 2007/0172591 | A1 | 7/2007 | Seo et al. | |
| 2007/0187678 | A1 | 8/2007 | Hirao et al. | |
| 2007/0187760 | A1 | 8/2007 | Furuta et al. | |
| 2007/0194379 | A1 | 8/2007 | Hosono et al. | |
| 2007/0252928 | A1 | 11/2007 | Ito et al. | |
| 2007/0272922 | A1 | 11/2007 | Kim et al. | |
| 2007/0287296 | A1 | 12/2007 | Chang | |
| 2008/0006877 | A1 | 1/2008 | Mardilovich et al. | |
| 2008/0038882 | A1 | 2/2008 | Takechi et al. | |
| 2008/0038929 | A1* | 2/2008 | Chang | 438/722 |
| 2008/0050595 | A1 | 2/2008 | Nakagawara et al. | |
| 2008/0073653 | A1 | 3/2008 | Iwasaki | |
| 2008/0083950 | A1 | 4/2008 | Pan et al. | |
| 2008/0106191 | A1 | 5/2008 | Kawase | |
| 2008/0128689 | A1 | 6/2008 | Lee et al. | |
| 2008/0129195 | A1 | 6/2008 | Ishizaki et al. | |
| 2008/0166834 | A1 | 7/2008 | Kim et al. | |
| 2008/0170028 | A1* | 7/2008 | Yoshida | 345/100 |
| 2008/0182358 | A1 | 7/2008 | Cowdery-Corvan et al. | |
| 2008/0224133 | A1 | 9/2008 | Park et al. | |
| 2008/0254569 | A1 | 10/2008 | Hoffman et al. | |
| 2008/0258139 | A1 | 10/2008 | Ito et al. | |
| 2008/0258140 | A1 | 10/2008 | Lee et al. | |
| 2008/0258141 | A1 | 10/2008 | Park et al. | |
| 2008/0258143 | A1 | 10/2008 | Kim et al. | |
| 2008/0296568 | A1 | 12/2008 | Ryu et al. | |
| 2008/0309652 | A1 | 12/2008 | Ostlund | |
| 2009/0008638 | A1* | 1/2009 | Kang et al. | 257/43 |
| 2009/0021536 | A1* | 1/2009 | Abe et al. | 345/690 |
| 2009/0068773 | A1 | 3/2009 | Lai et al. | |
| 2009/0073325 | A1 | 3/2009 | Kuwabara et al. | |
| 2009/0114910 | A1 | 5/2009 | Chang | |
| 2009/0134399 | A1 | 5/2009 | Sakakura et al. | |
| 2009/0152506 | A1 | 6/2009 | Umeda et al. | |
| 2009/0152541 | A1 | 6/2009 | Maekawa et al. | |
| 2009/0185082 | A1* | 7/2009 | Hashimoto | 348/739 |
| 2009/0278122 | A1 | 11/2009 | Hosono et al. | |
| 2009/0280600 | A1 | 11/2009 | Hosono et al. | |
| 2009/0294764 | A1* | 12/2009 | Kim et al. | 257/43 |
| 2010/0011315 | A1* | 1/2010 | Araki | 715/783 |
| 2010/0065844 | A1 | 3/2010 | Tokunaga | |
| 2010/0092800 | A1 | 4/2010 | Itagaki et al. | |
| 2010/0109002 | A1 | 5/2010 | Itagaki et al. | |
| 2010/0166383 | A1* | 7/2010 | Goel | 386/68 |
| 2010/0198582 | A1* | 8/2010 | Johnson | 704/8 |
| 2011/0090183 | A1 | 4/2011 | Yamazaki et al. | |
| 2011/0148826 | A1 | 6/2011 | Koyama et al. | |
| 2011/0148846 | A1 | 6/2011 | Arasawa et al. | |
| 2011/0157216 | A1 | 6/2011 | Yamazaki et al. | |
| 2011/0157254 | A1 | 6/2011 | Yamazaki et al. | |

FOREIGN PATENT DOCUMENTS

| | | | |
|---|---|---|---|
| EP | 1 737 044 | A1 | 12/2006 |
| EP | 2 226 847 | A2 | 9/2010 |
| JP | 60-198861 | A | 10/1985 |
| JP | 63-210022 | A | 8/1988 |
| JP | 63-210023 | A | 8/1988 |
| JP | 63-210024 | A | 8/1988 |
| JP | 63-215519 | A | 9/1988 |
| JP | 63-239117 | A | 10/1988 |
| JP | 63-265818 | A | 11/1988 |
| JP | 05-224626 | A | 9/1993 |
| JP | 05-251705 | A | 9/1993 |
| JP | 05-265961 | A | 10/1993 |
| JP | 08-264794 | A | 10/1996 |
| JP | 11-505377 | A | 5/1999 |
| JP | 2000-044236 | A | 2/2000 |
| JP | 2000-150900 | A | 5/2000 |
| JP | 2001-312253 | A | 11/2001 |
| JP | 2002-076356 | A | 3/2002 |
| JP | 2002-223291 | A | 8/2002 |
| JP | 2002-289859 | A | 10/2002 |
| JP | 2003-086000 | A | 3/2003 |
| JP | 2003-086808 | A | 3/2003 |
| JP | 2004-103957 | A | 4/2004 |
| JP | 2004-273614 | A | 9/2004 |
| JP | 2004-273732 | A | 9/2004 |
| JP | 2006-165528 | A | 6/2006 |
| JP | 2007-096055 | A | 4/2007 |
| JP | 2007-123861 | A | 5/2007 |
| JP | 2008-065225 | A | 3/2008 |
| JP | 2008-233925 | A | 10/2008 |
| WO | 2004/114391 | A1 | 12/2004 |

OTHER PUBLICATIONS

Asaoka, Y et al., "29.1: Polarizer-Free Reflective LCD Combined With Ultra Low-Power Driving Technology," SID Digest '09 : SID International Symposium Digest of Technical Papers, 2009, pp. 395-398.

(56) References Cited

OTHER PUBLICATIONS

Chern, H et al., "An Analytical Model for the Above-Threshold Characteristics of Polysilicon Thin-Film Transistors," IEEE Transactions on Electron Devices, Jul. 1, 1995, vol. 42, No. 7, pp. 1240-1246.
Cho, D et al., "21.2: Al and Sn-Doped Zinc Indium Oxide Thin Film Transistors for Amoled Back-Plane," SID Digest '09 : SID International Symposium Digest of Technical Papers, May 31, 2009, pp. 280-283.
Clark, S et al.. "First Principles Methods Using CASTEP," Zeitschrift fur Kristallographie, 2005, vol. 220, pp. 567-570.
Coates. D et al., Optical Studies of the Amorphous Liquid-Cholesteric Liquid Crystal Transition: The "Blue Phase," Physics Letters, Sep. 10, 1973, vol. 45A, No. 2, pp. 115-116.
Costello, M et al., "Electron Microscopy of a Cholesteric Liquid Crystal and Its Blue Phase," Phys. Rev. A (Physical Review. A), May 1, 1984, vol. 29, No. 5, pp. 2957-2959.
Dembo, H et al., "RFCPUS on Glass and Plastic Substrates Fabricated by TFT Transfer Technology," IEDM 05: Technical Digest of International Electron Devices Meeting, Dec. 5, 2005, pp. 1067-1069.
Fortunato, E et al., "Wide-Bandgap High-Mobility ZnO Thin-Film Transistors Produced At Room Temperature," Appl. Phys. Lett. (Applied Physics Letters), Sep. 27, 2004, vol. 85, No. 13, pp. 2541-2543.
Fung, T et al., "2-D Numerical Simulation of High Performance Amorphous In—Ga—Zn—O TFTs for Flat Panel Displays," AM-FPD '08 Digest of Technical Papers, Jul. 2, 2008, pp. 251-252, The Japan Society of Applied Physics.
Godo, H et al., "P-9: Numerical Analysis on Temperature Dependence of Characteristics of Amorphous In—Ga—Zn-Oxide TFT," SID Digest '09 : SID International Symposium Digest of Technical Papers, May 31, 2009, pp. 1110-1112.
Godo, H et al., "Temperature Dependence of Characteristics and Electronic Structure for Amorphous In—Ga—Zn-Oxide TFT," AM-FPD '09 Digest of Technical Papers, Jul. 1, 2009, pp. 41-44.
Hayashi, R et al., "42.1: Invited Paper: Improved Amorphous In—Ga—Zn—O TFTs," SID Digest '08 : SID International Symposium Digest of Technical Papers, May 20, 2008, vol. 39, pp. 621-624.
Hirao, T et al., "Novel Top-Gate Zinc Oxide Thin-Film Transistors (ZnO TFTs) for AMLCDs," Journal of the SID , 2007, vol. 15, No. 1, pp. 17-22.
Hosono, H et al., "Working hypothesis to explore novel wide band gap electrically conducting amorphous oxides and examples," J. Non-Cryst. Solids (Journal of Non-Crystalline Solids), 1996, vol. 198-200, pp. 165-169.
Hosono, H, "68.3: Invited Paper:Transparent Amorphous Oxide Semiconductors for High Performance TFT," SID Digest '07 : SID International Symposium Digest of Technical Papers, 2007, vol. 38, pp. 1830-1833.
Hsieh, H et al., "P-29: Modeling of Amorphous Oxide Semiconductor Thin Film Transistors and Subgap Density of States," SID Digest '08 : SID International Symposium Digest of Technical Papers, 2008, vol. 39, pp. 1277-1280.
Ikeda, T et al., "Full-Functional System Liquid Crystal Display Using CG-Silicon Technology," SID Digest '04 : SID International Symposium Digest of Technical Papers, 2004, vol. 35, pp. 860-863.
Janotti, A et al., "Native Point Defects in ZnO," Phys. Rev. B (Physical Review. B), 2007, vol. 76, No. 16, pp. 165202-1-165202-22.
Janotti, A et al., "Oxygen Vacancies in ZnO," Appl. Phys. Lett. (Applied Physics Letters), 2005, vol. 87, pp. 122102-1-122102-3.
Jeong, J et al., "3.1: Distinguished Paper: 12.1-Inch WXGA AMOLED Display Driven by Indium—Gallium—Zinc Oxide TFTs Array," SID Digest '08 : SID International Symposium Digest of Technical Papers, May 20, 2008, vol. 39, No. 1, pp. 1-4.
Jin, D et al., "65.2: Distinguished Paper:World-Largest (6.5") Flexible Full Color Top Emission AMOLED Display on Plastic Film and Its Bending Properties," SID Digest '09 : SID International Symposium Digest of Technical Papers, May 31, 2009, pp. 983-985.
Kanno, H et al., "White Stacked Electrophosphorecent Organic Light-Emitting Devices Employing MOO3 as a Charge-Generation Layer," Adv. Mater. (Advanced Materials), 2006, vol. 18, No. 3, pp. 339-342.
Kikuchi, H et al., "39.1: Invited Paper: Optically Isotropic Nano-Structured Liquid Crystal Composites for Display Applications," SID Digest '09 : SID International Symposium Digest of Technical Papers, May 31, 2009, pp. 578-581.
Kikuchi, H et al., "62.2: Invited Paper: Fast Electro-Optical Switching in Polymer-Stabilized Liquid Crystalline Blue Phases for Display Application," SID Digest '07 : SID International Symposium Digest of Technical Papers, 2007, vol. 38, pp. 1737-1740.
Kikuchi, H et al., "Polymer-Stabilized Liquid Crystal Blue Phases," Nature Materials, Sep. 1, 2002, vol. 1, pp. 64-68.
Kim, S et al., "High-Performance oxide thin film transistors passivated by various gas plasmas." The Electrochemical Society, 214th ECS Meeting, 2008, No. 2317, 1 page.
Kimizuka, N. et al., "Spinel,YbFe2O4, and Yb2Fe3O7 Types of Structures for Compounds in the In2O3 and Sc203-A2O3-BO Systems [A; Fe, Ga, or Al; B: Mg, Mn, Fe, Ni, Cu,or Zn] at Temperatures Over 1000 ° C. ," Journal of Solid State Chemistry, 1985, vol. 60, pp. 382-384.
Kimizuka, N et al., "Syntheses and Single-Crystal Data of Homologous Compounds, In2O3(ZnO)m (m=3, 4, and 5), InGaO3(ZnO)3, and Ga2O3(ZnO)m (m=7, 8, 9, and 16) in the In2O3-ZnGa2O4-ZnO System," Journal of Solid State Chemistry, Apr. 1, 1995, vol. 116, No. 1, pp. 170-178.
Kitzerow, H et al., "Observation of Blue Phases in Chiral Networks," Liquid Crystals, 1993, vol. 14, No. 3, pp. 911-916.
Kurokawa, Y et al., "UHF RFCPUS on Flexible and Glass Substrates for Secure RFID Systems," Journal of Solid-State Circuits , 2008, vol. 43, No. 1, pp. 292-299.
Lany, S et al., "Dopability, Intrinsic Conductivity, and Nonstoichiometry of Transparent Conducting Oxides," Phys. Rev. Lett. (Physical Review Letters), Jan. 26, 2007, vol. 98, pp. 045501-1-045501-4.
Lee, H et al., "Current Status of, Challenges to, and Perspective View of AM-OLED," IDW '06 : Proceedings of the 13th International Display Workshops, Dec. 7, 2006, pp. 663-666.
Lee, J et al., "World's Largest (15-Inch) XGA AMLCD Panel Using IGZO Oxide TFT," SID Digest '08 : SID International Symposium Digest of Technical Papers, May 20, 2008, vol. 39, pp. 625-628.
Lee, M et al., "15.4: Excellent Performance of Indium—Oxide-Based Thin-Film Transistors by DC Sputtering," SID Digest '09 : SID International Symposium Digest of Technical Papers, May 31, 2009, pp. 191-193.
Li, C et al "Modulated Structures of Homologous Compounds InMO3(ZnO)m (M=In,Ga; m=Integer) Described by Four-Dimensional Superspace Group," Journal of Solid State Chemistry, 1998, vol. 139, pp. 347-355.
Masuda, S et al., "Transparent thin film transistors using ZnO as an active channel layer and their electrical properties," J. Appl. Phys. (Journal of Applied Physics), Feb. 1, 2003, vol. 93, No. 3, pp. 1624-1630.
Meiboom, S et al., "Theory of the Blue Phase of Cholesteric Liquid Crystals," Phys. Rev. Lett. (Physical Review Letters), May 4, 1981, vol. 46, No. 18, pp. 1216-1219.
Miyasaka, M, "Suftla Flexible Microelectronics on Their Way to Business," SID Digest '07 : SID International Symposium Digest of Technical Papers, 2007, vol. 38, pp. 1673-1676.
Mo, Y et al., "Amorphous Oxide TFT Backplanes for Large Size AMOLED Displays," IDW '08 : Proceedings of the 6th International Display Workshops, Dec. 3, 2008, pp. 581-584.
Nakamura, "Synthesis of Homologous Compound with New Long-Period Structure," NIRIM Newsletter, Mar. 1995, vol. 150, pp. 1-4 with English translation.
Nakamura, M et al., "The phase relations in the In2O3-Ga2ZnO4-ZnO system at 1350° C.," Journal of Solid State Chemistry, Aug. 1, 1991, vol. 93, No. 2, pp. 298-315.
Nomura, K et al., "Thin-Film Transistor Fabricated in Single-Crystalline Transparent Oxide Semiconductor," Science, May 23, 2003, vol. 300, No. 5623, pp. 1269-1272.

(56) References Cited

OTHER PUBLICATIONS

Nomura, K et al., "Amorphous Oxide Semiconductors for High-Performance Flexible Thin-Film Transistors," Jpn. J. Appl. Phys. (Japanese Journal of Applied Physics) , 2006, vol. 45, No. 5B, pp. 4303-4308.
Nomura, K et al., "Room-Temperature Fabrication of Transparent Flexible Thin-Film Transistors Using Amorphous Oxide Semiconductors," Nature, Nov. 25, 2004, vol. 432, pp. 488-492.
Nomura, K et al., "Carrier transport in transparent oxide semiconductor with intrinsic structural randomness probed using single-crystalline InGaO3(ZnO)5 films," Appl. Phys. Lett. (Applied Physics Letters) , Sep. 13. 2004, vol. 85, No. 11, pp. 1993-1995.
Nowatari, H et al., "60.2: Intermediate Connector With Suppressed Voltage Loss for White Tandem OLEDs," SID Digest '09 : SID International Symposium Digest of Technical Papers, May 31, 2009, vol. 40, pp. 899-902.
Oba, F et al., "Defect energetics in ZnO: A hybrid Hartree-Fock density functional study," Phys. Rev. B (Physical Review. B), 2008, vol. 77, pp. 245202-1-245202-6.
Oh, M et al., "Improving the Gate Stability of ZnO Thin-Film Transistors With Aluminum Oxide Dielectric Layers," J. Electrochem. Soc. (Journal of the Electrochemical Society), 2008, vol. 155, No. 12, pp. H1009-H1014.
Ohara, H et al., "21.3: 4.0 In. QVGA AMOLED Display Using In—Ga—Zn-Oxide TFTs With a Novel Passivation Layer," SID Digest '09 : SID International Symposium Digest of Technical Papers, May 31, 2009, pp. 284-287.
Ohara, H et al., "Amorphous In—Ga—Zn-Oxide TFTs with Suppressed Variation for 4.0 inch QVGA AMOLED Display," AM-FPD '09 Digest of Technical Papers, Jul. 1, 2009, pp. 227-230, The Japan Society of Applied Physics.
Orita, M et al., "Amorphous transparent conductive oxide InGaO3(ZnO)m (m<4):a Zn4s conductor," Philosophical Magazine, 2001, vol. 81, No. 5, pp. 501-515.
Orita, M et al., "Mechanism of Electrical Conductivity of Transparent InGaZnO4," Phys. Rev. B (Physical Review. B), Jan. 15, 2000, vol. 61, No. 3, pp. 1811-1816.
Osada, T et al., "15.2: Development of Driver-Integrated Panel using Amorphous In—Ga—Zn-Oxide TFT," SID Digest '09 : SID International Symposium Digest of Technical Papers, May 31, 2009, pp. 184-187.
Osada, T et al., "Development of Driver-Integrated Panel Using Amorphous In—Ga—Zn-Oxide TFT," AM-FPD '09 Digest of Technical Papers, Jul. 1, 2009, pp. 33-36.
Park, J et al., "Dry etching of ZnO films and plasma-induced damage to optical properties," J. Vac. Sci. Technol. B (Journal of Vacuum Science & Technology B), Mar. 1, 2003, vol. 21, No. 2, pp. 800-803.
Park, J et al., "Improvements in the Device Characteristics of Amorphous Indium Gallium Zinc Oxide Thin-Film Transistors by Ar Plasma Treatment," Appl. Phys. Lett. (Applied Physics Letters), Jun. 26, 2007, vol. 90, No. 26, pp. 262106-1-262106-3.
Park, J et al., "Electronic Transport Properties of Amorphous Indium—Gallium—Zinc Oxide Semiconductor Upon Exposure to Water," Appl. Phys. Lett. (Applied Physics Letters), 2008, vol. 92, pp. 072104-1-072104-3.
Park, J et al., "High performance amorphous oxide thin film transistors with self-aligned top-gate structure," IEDM 09: Technical Digest of International Electron Devices Meeting, Dec. 7, 2009, pp. 191-194.
Park, Sang-Hee et al., "42.3: Transparent ZnO Thin Film Transistor for the Application of High Aperture Ratio Bottom Emission AM-OLED Display," SID Digest '08 : SID International Symposium Digest of Technical Papers, May 20, 2008, vol. 39, pp. 629-632.
Park, J et al., "Amorphous Indium—Gallium—Zinc Oxide TFTs and Their Application for Large Size AMOLED," AM-FPD '08 Digest of Technical Papers, Jul. 2, 2008, pp. 275-278.
Park, S et al., "Challenge to Future Displays: Transparent AM-OLED Driven by Peald Grown ZnO TFT," IMID '07 Digest, 2007, pp. 1249-1252.
Prins, M et al., "A Ferroelectric Transparent Thin-Film Transistor," Appl. Phys. Lett. (Applied Physics Letters), Jun. 17, 1996, vol. 68, No. 25, pp. 3650-3652.
Sakata, J et al., "Development of 4.0-In. AMOLED Display With Driver Circuit Using Amorphous In—Ga—Zn-Oxide TFTs," IDW '09 : Proceedings of the 16th International Display Workshops, 2009, pp. 689-692.
Son, K et al., "42.4L: Late-News Paper: 4 Inch QVGA AMOLED Driven by the Threshold Voltage Controlled Amorphous GIZO (Ga2O3-In2O3-ZnO) TFT," SID Digest '08 : SID International Symposium Digest of Technical Papers, May 20, 2008, vol. 39, pp. 633-636.
Takahashi, M et al., "Theoretical Analysis of IGZO Transparent Amorphous Oxide Semiconductor," IDW '08 : Proceedings of the 15th International Display Workshops, Dec. 3, 2008, pp. 1637-1640.
Tsuda, K et al., "Ultra Low Power Consumption Technologies for Mobile TFT-LCDs," IDW '02 : Proceedings of the 9th International Display Workshops, Dec. 4, 2002, pp. 295-298.
Ueno, K et al., "Field-Effect Transistor on SrTiO3 With Sputtered Al2O3 Gate Insulator," Appl. Phys. Lett. (Applied Physics Letters), Sep. 1, 2003, vol. 83, No. 9, pp. 1755-1757.
Van De Walle, C, "Hydrogen as a Cause of Doping in Zinc Oxide," Phys. Rev. Lett. (Physical Review Letters), Jul. 31, 2000, vol. 85, No. 5, pp. 1012-1015.
International Search Report, PCT Application No. PCT/JP2011/050902, dated Apr. 26, 2011, 3 pages.
Written Opinion, PCT Application No. PCT/JP2011/050902, dated Apr. 26, 2011, 6 pages.
Chinese Office Action (Application No. 201180006612.6) Dated Sep. 5, 2014.

* cited by examiner

| extension | operation |
|---|---|
| txt | still image mode |
| mp4 | moving image mode |
| avi | moving image mode |
| jpg | still image mode |
| ⋮ | ⋮ |

DISPLAY METHOD OF DISPLAY DEVICE

TECHNICAL FIELD

The present invention relates to a display method of a display device, using a file including data for controlling the display device.

BACKGROUND ART

There have been active matrix display devices in which a plurality of pixels is arranged in matrix, and a switching transistor and a display element which is connected to the switching transistor are provided for each pixel.

As a switching transistor preferable for the active matrix display device, a transistor including a channel formation region including metal oxide has drawn attention (Patent Documents 1 and 2). Further, as examples of a display element applicable to the active matrix display device, a liquid crystal element, electronic ink using an electrophoresis method, and the like can be given.

Active matrix display devices using liquid crystal elements have been used in wide application from moving image display taking advantage of high operation speed of the liquid crystal element to still image display with a wide range of gray levels.

Active matrix display devices using electronic ink have been used for display devices with extremely low power consumption, taking advantage of so-called memory properties, a feature of the electronic ink, by which a displayed image is kept even after power supply is stopped.

REFERENCE

Patent Document 1: Japanese Published Patent Application No. 2007-123861

Patent Document 2: Japanese Published Patent Application No. 2007-096055

DISCLOSURE OF INVENTION

The switching transistor included in the conventional active matrix display device has a drawback in that the off-state current is high and thus a signal written into a pixel leaks to be lost even in the off state. Although such a drawback does not matter in the case of displaying a moving image, frequent signal rewriting into pixels is needed even in the case of keeping displaying the same image such as a still image, which stymies cut of power loss.

In view of the above, a method for reducing power consumption in which a display element having memory properties is applied to the active matrix display device has been used. However, many of the display elements having memory properties have drawbacks of low operation speed, and thus, they cannot follow high-speed operation of the switching transistor provided in the pixel and it is difficult to display a moving image.

Further, in display devices for displaying both a moving image and a still image, a display device which enables both moving image display and low power consumption, using, for example, a method for controlling the frequency of signal writings into a pixel in accordance with the display image characteristics has been demanded.

Moreover, with an advance of the information society, moving images and still images have come to be provided by a digital data file. However, a variety of formats have been used for the digital data file, which makes it quite difficult for users to select a display method accordingly.

On the other hand, user's selectability of operation of the display device in accordance with the state of the display device (e.g., remaining battery level) or at his/her request has also be demanded for the display devices.

The present invention is made in view of the foregoing technical background. Therefore, it is an object of the present invention to provide a display method suitable for an image provided by a digital data file.

Further, it is an object to provide a display method of a display device, in which the image quality and power consumption are adjusted to display an image in accordance with the state of the display device or at user's request.

In order to achieve the above object, an image provided by a digital data file may be displayed on a display device in which a plurality of pixels each having a pixel electrode connected to a switching element whose off-state current is reduced, using data which is provided by the digital data file and is correlated to an operation of the display device.

According to an embodiment of the present invention, a display method is provided in which an image is displayed on a display device in which a plurality of pixels each having a pixel electrode connected to a switching element whose off-state current is reduced, using an image provided by a digital data file and data which is provided by the digital data file and is correlated to an operation of the display device.

According to an embodiment of the present invention, a display method of a display device including a display panel and an image processing circuit is provided. The display panel includes a plurality of pixels. The pixel is connected to a scan line and a signal line and has a transistor whose off-state current is reduced and a pixel electrode connected to the transistor. The pixel electrode controls an alignment of liquid crystals. The image processing circuit includes a memory circuit for holding data which is provided by a digital data file and is correlated to an operation of the display device and a display control circuit for outputting an image signal and a control signal to the display panel in accordance with the data which is provided by a digital data file and is correlated to an operation of the display device.

According to an embodiment of the present invention, in the above-described display method of the display device, the data which is provided by a digital data file and is correlated to an operation of the display device is an extension of the digital data file.

According to an embodiment of the present invention, in the above-described display method of the display device, the data which is provided by a digital data file and is correlated to an operation of the display device is a script of the digital data file.

According to an embodiment of the present invention, in the above-described display method of the display device, the data which is provided by a digital data file and is correlated to an operation of the display device is a header of the digital data file.

According to an embodiment of the present invention, in the above-described display method of the display device, a liquid crystal element which is connected to a transistor including a highly purified oxide semiconductor layer is included in the pixel.

Voltage refers to a potential difference between a given potential and a reference potential (e.g., a ground potential) in many cases in this description and the like. Therefore, voltage, potential, and a potential difference can be referred to as potential, voltage, and a voltage difference, respectively.

According to the present invention, a display method suitable for an image provided by a digital data file can be provided. Further, a display method of a display device, for adjusting the image quality and power consumption to display an image in accordance with the state of the display device or at user's request can be provided.

BEST MODE FOR CARRYING OUT THE INVENTION

Figure 1:
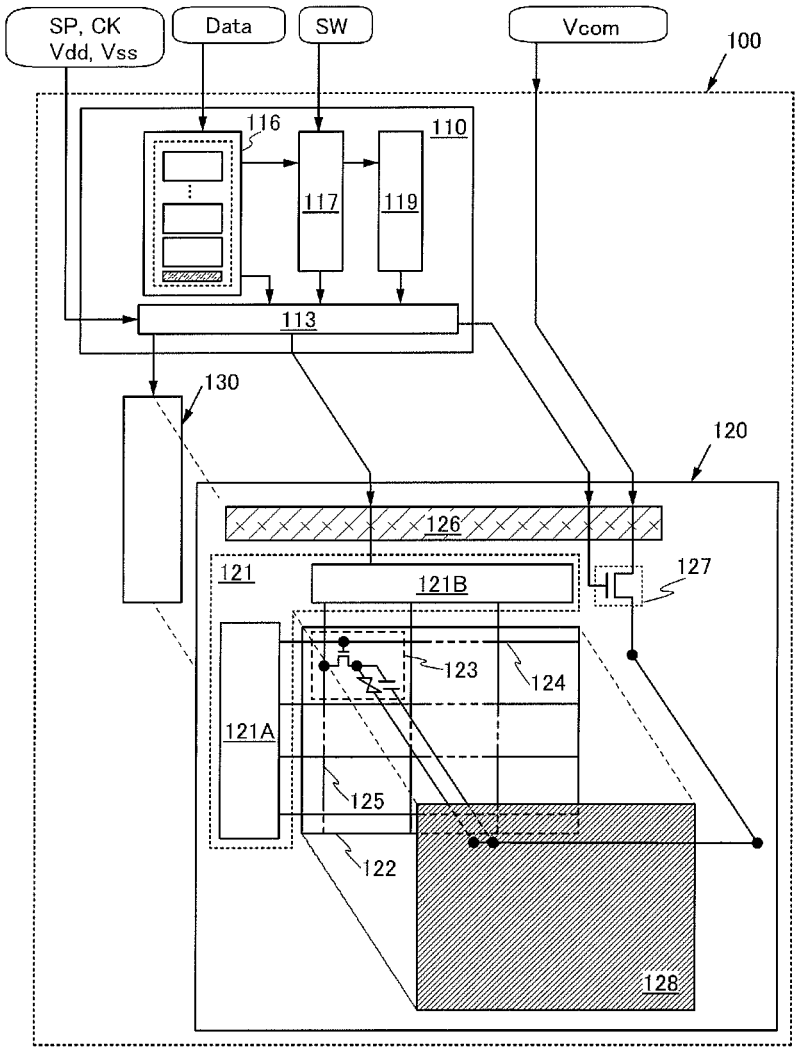
FIG. 1 is a block diagram illustrating a structure of a display device according to an embodiment.

Embodiments of the present invention will be described below with reference to the accompanying drawings. Note that the present invention is not limited to the following description, and it is easily understood by those skilled in the art that modes and details disclosed herein can be modified in various ways without departing from the spirit and the scope of the present invention. Therefore, the present invention is not construed as being limited to the content of the embodiments included herein. In the structures of the present invention described below, the same portions or portions having similar functions are denoted by the same reference numerals throughout the drawings, and description of such portions is not repeated.

Embodiment 1

In Embodiment 1, a structure and a method of a display device in which an operation of the display device is decided in accordance with the kind of an image which is provided by a digital data file and the image is displayed will be described using FIG. 1, FIGS. 2A and 2B, FIG. 3, FIG. 4, FIGS. 5A and 5B, and FIG. 6.

Each structure of a display device 100 according to one embodiment of this description is described using a block diagram of FIG. 1. The display device 100 of this embodiment includes an image processing circuit 110, a display panel 120, and a lighting unit 130.

A control signal, a digital data file, and a power supply potential are supplied to the display device 100 of this embodiment from an external device. A start pulse SP and a clock signal CK are supplied as control signals, and a high power supply potential Vdd, a low power supply potential Vss, and a common potential Vcom are supplied as power supply potentials. Further, an image and data which is correlated to an operation of the display device are supplied to a memory circuit 116 by the digital data file.

The high power supply potential Vdd is a potential higher than a reference potential, and the low power supply potential Vss is a potential lower than or equal to the reference potential. It is preferable that both the high power supply potential Vdd and the low power supply potential Vss are potentials at which a transistor can operate. The high power supply potential Vdd and the low power supply potential Vss are collectively referred to as a power supply voltage in some cases.

The common potential Vcom is any potential as long as it serves as a reference with respect to a potential of an image signal supplied to a pixel electrode; for example, a ground potential.

An image is provided by the digital data file. The digital data file of an image is in some cases compressed in order to reduce the volume. The digital data file itself may contain image data or may be a script file which specifies the location of an image file stored in an external memory circuit, or the like. The volume of the digital data file can be decreased by storing an image file in the external memory circuit.

Further, data which is correlated to an operation of the display device is provided by the digital data file. There is no particular limitation on the data which is correlated to an operation of the display device as long as it specifies the operation of the display device. For example, a command and/or data which specify/specifies an interval, a frequency, the number of times, and the like of image writings into the display device, or the like can be given. As other examples thereof, data which specifies the position at which an image is displayed for the display device, a command for driving with a plurality of display screens of the display device divided, and the like can be given.

The format for providing the data which is correlated to an operation of the display device is not particularly limited. For example, an extension of a digital data file, a script written in a digital data file, a header in a digital data file, or the like can be used.

The data which is correlated to an operation of the display device, which is provided by the digital data file, is not necessarily dedicated data for a display device in which a pixel includes a switching element whose off-state current is reduced, and may contain dedicated data for the display device in which a pixel includes a switching element whose off-state current is reduced.

The digital data file is, after being read into the memory circuit 116, converted into an image signal Data in a display control circuit 113. The image signal Data may be appropriately inverted in accordance with dot inversion driving, source line inversion driving, gate line inversion driving, frame inversion driving, or the like to be input to the display panel 120.

Next, a structure of the image processing circuit 110 and a process of signal processing in the image processing circuit 110 are described below.

The image processing circuit 110 includes the memory circuit 116, a separation circuit 117, a decoder 119, and the display control circuit 113. The image processing circuit 110 generates a display panel signal and a lighting unit signal from a digital data file. The display panel signal contains a signal for controlling the display panel 120 and an image signal, and the lighting unit signal is a signal for controlling the lighting unit 130. Further, the image processing circuit 110 outputs a signal for controlling the potential of a common electrode portion 128 to a switching element 127.

The memory circuit 116 holds the input digital data file. The memory circuit 116 further holds a reference table in which extensions of digital data files are correlated to operation modes. The memory circuit may be formed using a memory element such as a dynamic random access memory (DRAM) or a static random access memory (SRAM).

The separation circuit 117 decides an operation of the image processing circuit 110. For example, the reference table in which extensions of digital data files are correlated to operation modes may be searched to decide a display operation. Further, the display operation may be decided in accordance with a value input through an input means SW by an external device or a user of the display device. Specifically, the separation circuit 117 selects which of the decoder 119 and the display control circuit 113 the digital data file held in the memory circuit 116 is output to. Further, in the case where the digital data file contains a reference frame, the separation circuit 117 separates and decodes the reference frame to generate an image for one frame, and outputs to the display control circuit 113.

The decoder 119 decodes a compressed image provided by the digital data file and outputs to the display control circuit 113.

The display control circuit 113 supplies a control signal (specifically a signal for switching supply and stop of the control signal such as a start pulse SP or a clock signal CK) and an image signal output from the separation circuit 117 or the decoder 119, to the display panel 120, and supplies the lighting unit signal (specifically a signal for turning on or off the lighting unit 130) to the lighting unit 130.

The lighting unit 130 includes a lighting unit control circuit and a light. The lighting unit may have a combination selected for the use application of the display device 100; for example, a light source for at least three primary colors of light is used in the case where a full-color image is displayed. In this embodiment, for example, a light-emitting element (e.g., an LED) which emits white light is provided. In the case where a transmissive liquid crystal element or a transflective liquid crystal element is used, the lighting unit may be disposed on the rear-surface side of a display element. In the case where a reflective liquid crystal element is used, the lighting unit may be disposed in a position on the display-surface side of the display element so as to irradiate the display element.

The lighting unit signal for controlling the lighting unit and the power supply potential are supplied to the lighting unit control circuit from the display control circuit 113. For example, a signal for limiting the lighting period of time may be supplied to the lighting unit control circuit to reduce power consumption.

The display panel 120 includes a pixel portion 122 and the switching element 127. In this embodiment, a first substrate and a second substrate are provided for the display panel 120. A driver circuit portion 121, the pixel portion 122, and the switching element 127 are provided for the first substrate. A common connection portion (also called a common contact) and the common electrode portion (also called a counter electrode portion) 128 are provided for the second substrate. The common connection portion electrically connects the first substrate to the second substrate and may be provided over the first substrate.

A plurality of gate lines 124 and a plurality of signal lines 125 are provided for the pixel portion 122, and a plurality of pixels 123 are arranged in matrix such that each pixel is surrounded by the gate line 124 and the signal line 125. In the display panel described in this embodiment, the gate lines 124 are extended from a gate line driver circuit 121A and the signal lines 125 are extended from a signal line driver circuit 121B.

The pixel 123 includes a transistor whose off-state current is reduced, a pixel electrode connected to the transistor, a capacitor, and a display element. The pixel electrode has a region having properties of transmitting visible light and a region which reflects visible light.

When the transistor whose off-state current is reduced and which is included in the pixel 123 is off, electric charge stored in the capacitor and the display element connected to the transistor does not leak so much through the transistor in the off-state and the data written before the transistor is turned off can be kept for a long period of time.

A liquid crystal element can be given as an example of the display element. For example, the liquid crystal element is formed where a liquid crystal layer is provided between the pixel electrode and the common electrode portion which faces the pixel electrode. The region of the pixel, which transmits light, transmits light of the lighting unit and the region of the pixel electrode, which reflects visible light, reflects light which passes through the liquid crystal layer. The region of the pixel electrode which transmits light and the lighting unit 130 are not necessarily provided; a reflective liquid crystal element may be used without providing the region having light-transmitting properties of the pixel electrode and the lighting unit 130 so that power consumption can be reduced.

An example of liquid crystal elements is an element which controls transmission and non-transmission of light by optical modulation of liquid crystals. The element can include a pair of electrodes and a liquid crystal layer. The optical modulation of liquid crystals is controlled by an electric field applied to the liquid crystals (that is, an electric field in a vertical direction).

As examples of liquid crystals applied to a liquid crystal element, the following can be given: a nematic liquid crystal, a cholesteric liquid crystal, a smectic liquid crystal, a discotic liquid crystal, a thermotropic liquid crystal, a lyotropic liquid crystal, a low-molecular liquid crystal, a polymer dispersed liquid crystal (PDLC), a ferroelectric liquid crystal, an anti-ferroelectric liquid crystal, a main-chain liquid crystal, a side-chain high-molecular liquid crystal, a banana-shaped liquid crystal, and the like.

In addition, as examples of a diving method of liquid crystals, the following can be given: a TN (twisted nematic) mode, an STN (super twisted nematic) mode, an OCB (optically compensated birefringence) mode, an ECB (electrically controlled birefringence) mode, an FLC (ferroelectric liquid crystal) mode, an AFLC (anti-ferroelectric liquid crystal) mode, a PDLC (polymer dispersed liquid crystal) mode, a PNLC (polymer network liquid crystal) mode, a guest-host mode, and the like.

The driver circuit portion 121 includes the gate line driver circuit 121A and the signal line driver circuit 121B. The gate line driver circuit 121A and the signal line driver circuit 121B are driver circuits for driving the pixel portion 122 including a plurality of pixels, and include a shift register circuit (also called a shift register).

The gate line driver circuit 121A and the signal line driver circuit 121B may be formed over the same substrate as the pixel portion 122 or the switching element 127, or may be formed over another substrate.

The high power supply potential Vdd, the low power supply potential Vss, the start pulse SP, the clock signal CK, and the image signal Data are controlled by the display control circuit 113 and then supplied to the driver circuit portion 121.

A terminal portion 126 is an input terminal for supplying to the driver circuit portion 121 predetermined signals (e.g., the high power supply potential Vdd, the low power supply potential Vss, the start pulse SP, the clock signal CK, the image signal Data, the common potential Vcom) output from the display control circuit 113 included in the image processing circuit 110.

The switching element 127 supplies the common potential Vcom to the common electrode portion 128 in accordance with the control signal output from the display control circuit 113. A transistor can be used as the switching element 127. A gate electrode of the transistor may be connected to the display control circuit 113, the common potential Vcom may be supplied to one of a source electrode and a drain electrode of the transistor via the terminal portion 126, and the other of the source electrode and the drain electrode of the transistor may be connected to the common electrode portion 128. The switching element 127 may be formed over the same substrate as the driver circuit portion 121 or the pixel portion 122, or may be formed over another substrate.

The common connection portion is electrically connected to the common electrode portion 128 via a terminal connected to the source electrode or the drain electrode of the switching element 127.

As a specific example of the common connection portion, a conductive particle in which an insulating sphere is coated with a thin metal film may be used, so that electrical connection is made. Two or more common connection portions may be provided for the first substrate and the second substrate.

It is preferable that the common electrode portion 128 be provided so as to overlap with the plurality of pixel electrodes provided in the pixel portion 122. The common electrode portion 128 and the pixel electrodes included in the pixel portion 122 may have a variety of opening patterns.

Figure 3:
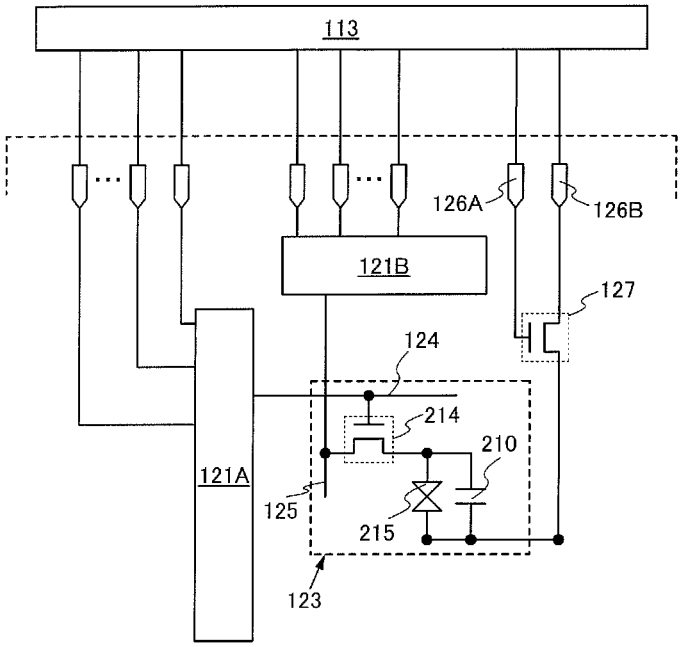
FIG. 3 is a block diagram illustrating a structure of a display panel according to an embodiment.

Next, a structure of the pixel 123 included in the pixel portion 122 is described below using an equivalent circuit shown in FIG. 3.

The pixel 123 includes a transistor 214, a display element 215, and a capacitor 210. A liquid crystal element is used as the display element 215 in this embodiment. The liquid crystal element is formed where a liquid crystal layer is provided between the pixel electrode over the first substrate and the common electrode portion 128 over the second substrate.

A gate electrode of the transistor 214 is connected to one of the plurality of gate lines 124 provided for the pixel portion, one of a source electrode and a drain electrode of the transistor 214 is connected to one of the plurality of signal lines 125, and the other of the source electrode and the drain electrode of the transistor 214 is connected to one electrode of the capacitor 210 and one electrode of the display element 215.

A transistor whose off-state current is reduced is used as the transistor 214. When the transistor 214 is off, electric charge stored in the capacitor 210 and the display element 215 connected to the transistor 214 does not leak so much through the transistor 214 and the data written before the transistor 214 is turned off can be kept for a long period of time.

With this structure, the capacitor 210 can hold a voltage applied to the display element 215. The capacitor 210 is not necessarily provided. An electrode of the capacitor 210 may be connected to a capacitor line.

One of the source electrode and the drain electrode of the switching element 127 that is an embodiment of the switching element of the present invention is connected to the other electrode of the capacitor 210 and the other electrode of the display element 215, which are not connected to the transistor 214, and the other of the source electrode and the drain electrode of the switching element 127 is connected to a terminal 126B through the common terminal portion. A gate electrode of the switching element 127 is connected to a terminal 126A.

Next, the states of the signals supplied to the pixel 123 are described below using the equivalent circuit diagram of the display device of FIG. 3 and a timing chart shown in FIG. 4.

Figure 4:
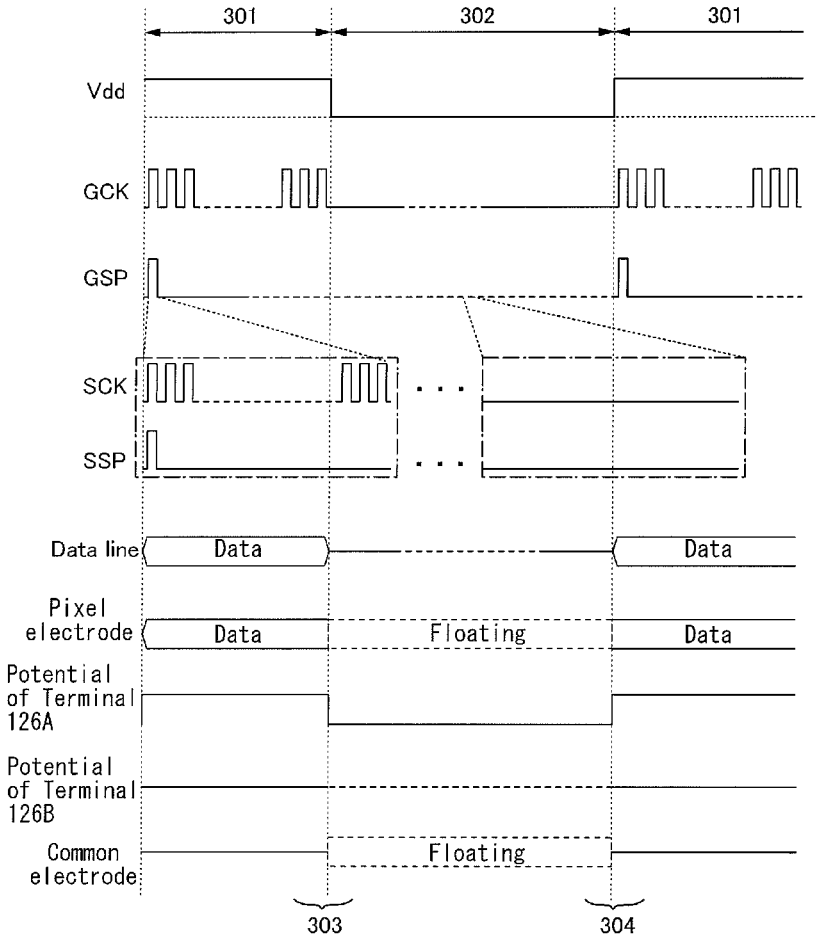
FIG. 4 is a timing chart illustrating an operation of a display device according to an embodiment.

In FIG. 4, a clock signal GCK and a start pulse GSP supplied from the display control circuit 113 to the gate line driver circuit 121A are shown. Further, a clock signal SCK and a start pulse SSP supplied from the display control circuit 113 to the signal line driver circuit 121B are also shown. In FIG. 4, the waveform of a clock signal is shown in the form of a simple square wave, for description on the output timing of the clock signal.

In addition, a potential of the signal line 125, a potential of the pixel electrode, a potential of the terminal 126A, a potential of the terminal 126B, and a potential of the common electrode portion are shown in FIG. 4.

A period 301 in FIG. 4 corresponds to a period during which an image signal is written. The image signal and the common potential are supplied to each pixel of the pixel portion 122 and the common electrode portion in the period 301.

Further, a period 302 corresponds to a period during which a still image is displayed. In the period 302, the supply of the image signal to each pixel in the pixel portion 122 and the supply of the common potential to the common electrode portion are stopped. Note that each signal is supplied so that operation of the driver circuit portion is stopped in the period 302 in FIG. 4; however, it is preferable to write an image signal periodically depending on the length of the period 302 and the refresh rate, so that a still image is prevented from deteriorating.

In the period 301, the clock signal GCK is supplied at all times, and the start pulse GSP is supplied in accordance with a vertical synchronizing frequency. Further in the period 301, the clock signal SCK is supplied at all times, and the start pulse SSP is supplied in accordance with one gate selection period.

Further, in the period 301, the image signal Data is supplied to the pixel in each row through the signal line 125, and the potential of the signal line 125 is supplied to the pixel electrode in accordance with the potential of the gate line 124.

Also in the period 301, the display control circuit supplies a potential at which the switching element 127 is turned on to the terminal 126A of the switching element 127, and supplies the common potential to the common electrode portion through the terminal 126B.

The period 302 is a period during which a still image is displayed. In the period 302, the supplies of the clock signal GCK, the start pulse GSP, the clock signal SCK, and the start pulse SSP are stopped, and the supply of the image signal Data, which is supplied to the signal line 125, is also stopped. In the period 302, during which the supplies of the clock signal GCK and the start pulse GSP are stopped, the transistor 214 is off and the pixel electrode is brought into a floating state.

Further, in the period 302, the display control circuit supplies a potential at which the switching element 127 is turned off to the terminal 126A of the switching element 127, which makes the common electrode portion into a floating state.

In the period 302, both of the electrodes of the display element 215, i.e., the pixel electrode and the common electrode portion can be brought into a floating state, and a still image can be displayed without supply of any another potential.

The supplies of the clock signals and the start pulses to the gate line driver circuit 121A and the signal line driver circuit 121B are stopped, whereby low power consumption can be achieved.

With the use of transistors whose off-state current is reduced as the transistor 214 and the switching element 127, drop of a voltage applied to the terminals of the display element 215 with time can be suppressed.

Figure 5A:
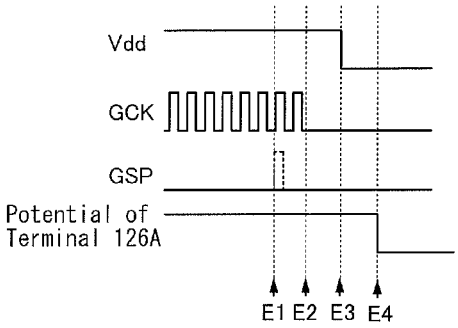
FIG. 5A is a timing chart illustrating an operation of a display device according to an embodiment.
Figure 5B:
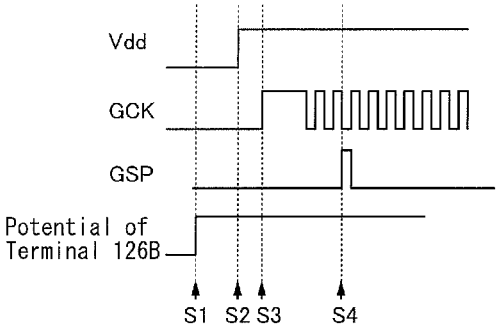
FIG. 5B is a timing chart illustrating an operation of a display device according to an embodiment.

Next, operations of the display control circuit in a period for switching the operation from image writing to written image holding (the period is a period 303 in FIG. 4) and in a period for switching the operation from the written image holding to image writing (the period is a period 304 in FIG. 4) are described below using FIGS. 5A and 5B. In FIGS. 5A and 5B, the high power supply potential Vdd, the clock signal (here, GCK), the start pulse signal (here, GSP), and the potential of the terminal 126A which is output from the display device are shown.

The operation of the display control circuit in the period for switching the operation from image writing to written image holding is shown in FIG. 5A. The display control circuit stops supplying the start pulse signal GSP (E1 in FIG. 5A, First Step). Next, after the supply of the start pulse signal GSP is stopped and pulse output reaches the last stage of the shift register, supply of the clock signal GCK is stopped (E2 in FIG. 5A, Second Step). Then, the high power supply potential Vdd of the power supply voltage is changed to the low power supply potential Vss (E3 in FIG. 5A, Third Step). After that, the potential of the terminal 126A is changed to a potential at which the switching element 127 is turned off (E4 in FIG. 5A, Fourth Step).

Through the above process, the supply of the signals to the driver circuit portion 121 can be stopped without causing malfunction of the driver circuit portion 121. It is preferable that a display control circuit provided for a display device be unlikely to malfunction because malfunction at the time when the operation is switched from image writing to written image holding causes noise which is written into an image and held.

The operation of the display control circuit in the period for switching the operation from written image holding to image writing is shown in FIG. 5B. The display control circuit changes the potential of the terminal 126A to a potential at which the switching element 127 is turned on (S1 in FIG. 5B, First Step). Next, the power supply voltage is changed from the low power supply potential Vss to the high power supply potential Vdd (S2 in FIG. 5B, Second Step). Then, after the potential at high level is supplied, the clock signal GCK is supplied (S3 in FIG. 5B, Third Step). Next, the start pulse signal GSP is supplied (S4 in FIG. 5B, Fourth Step).

Through the above process, the supply of the drive signals to the driver circuit portion 121 can be restarted without causing malfunction of the driver circuit portion 121. Respective potentials of the wirings are sequentially changed back to those at the time of image writing, whereby the driver circuit portion can be driven without malfunction.

Figure 6:
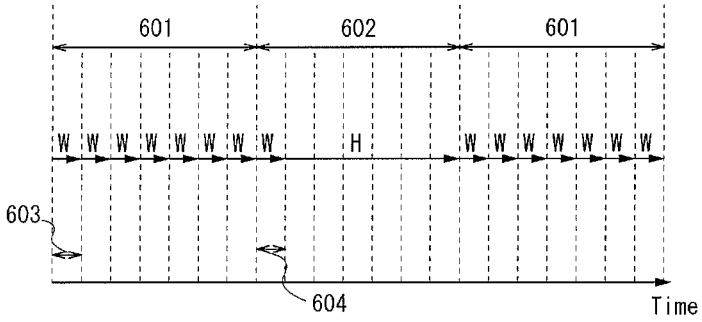
FIG. 6 is a timing chart illustrating an operation of a display device according to an embodiment.

FIG. 6 is a chart schematically showing in frame periods, the frequency of writing of image signals in a period 601 for writing images and in a period 602 for holding written images. In FIG. 6, W indicates a period for writing an image signal, and H indicates a period for holding an image signal. In addition, a period 603 is one frame period in FIG. 6; however, the period 603 may indicate a different period.

As shown in FIG. 6, according to the structure of the display device of this embodiment, an image signal for a display in the period 602 is written in a period 604 and then held in the other periods in the period 602.

Next, a method for displaying an image provided by a digital data file on the display device 100, using data correlated to an operation of the display device 100, which is provided by the digital data file is described below using FIGS. 2A and 2B. In this embodiment, an extension of a digital data file is used as the data correlated to an operation of the display device 100. A reference table in which extensions of files are correlated to operation modes is held in the memory circuit 116.

Figures 2A, 2B:
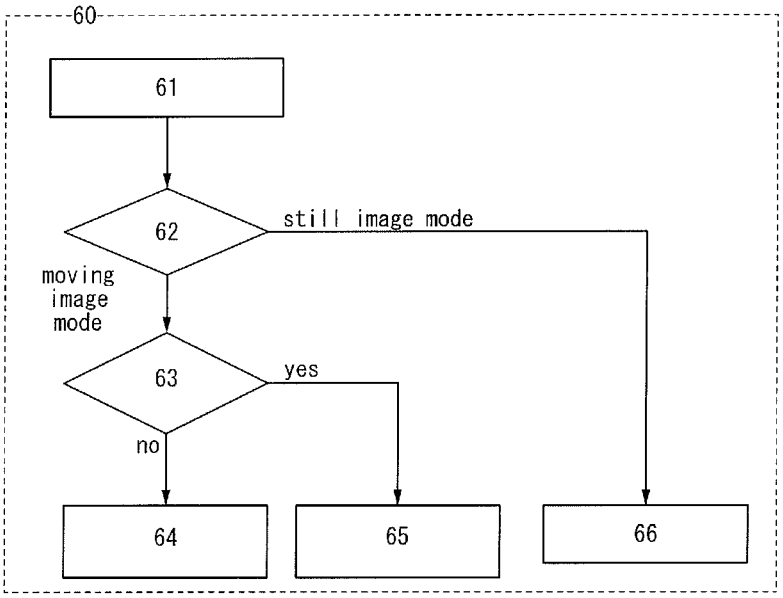
FIG. 2A is a diagram illustrating a selection method of an operation mode of a display device according to an embodiment and FIG. 2B is a reference table in which extensions are correlated to operation modes.

An example of the reference table in which extensions are correlated to operation modes is FIG. 2B. The reference table and the extensions described in the reference table in FIG. 2B are examples, and do not limit the file format applicable to the display device of this embodiment.

Next, a method for selecting an operation mode of the display device (operation mode selection mode 60) described in this embodiment is illustrated in FIG. 2A. A digital data file is input to the display device in a first step (data input 61). The display device searches the reference table in which extensions are correlated to operation modes, for an extension of the input digital data file, and determines an operation mode in a second step (extension discrimination 62). Specifically, in the case of a still image for which txt or jpg is given as the extension, a still image mode 66 in which the frequency of rewriting of the display panel is decreased is selected.

An operation used in a moving image mode is selected by a user in a third step (standard or simple play? 63). Specifically, either one of a standard play mode 64 in which all the frames of a moving image are reproduced and a simple play mode 65 in which some of the frames are reproduced is selected. In the standard play mode, a moving image is displayed in accordance with data on the rewriting frequency (frame rate) of the moving image, which is provided by a digital data file. In the simple play mode, for example, only reference frames among the frames are decoded, so that a load applied to the image processing circuit can be reduced and power consumption can be suppressed.

Conventional active matrix display devices have a drawback of leakage and loss of electric charge written into a pixel with time, and need to rewrite a signal into a pixel frequently even in the case of keeping displaying the same image such as a still image.

On the other hand, the display element provided in the display panel 120 in the display device 100 described in this embodiment is connected to the switching element whose off-state current is reduced. Electric charge stored in the capacitor and the display element connected to the transistor whose off-state current is reduced does not leak so much through the transistor in the off-state and the data written before the transistor is turned off can be kept for a long period of time.

As a result, the display device 100 described in this embodiment does not need to rewrite an image frequently into the display panel 120, and can decide the image writing frequency depending on the content of a display image. Specifically, in the case of displaying a still image, the frequency of rewriting of a still image, so-called refreshings can be reduced. Further, in the case of displaying a moving image, the writing frequency can be reduced because writing is not performed except for reference frames.

As described above, the method for displaying an image in which the image writing frequency is controlled depending on the content of the image provided by a digital data file is applied to the display device 100 described in this embodiment, whereby the rewriting frequency of the display panel can be decreased without degrading the image quality. As a result of this, power consumption can be reduced.

Further, since the file format is correlated to the operation mode in advance, it is convenient for users to have no need to select an operation mode in accordance with the format of a digital data file. In addition, users can choose an operation, so that a display device which operates in accordance with user's request can be provided.

Embodiment 1 can be implemented in appropriate combination with any other structure described in the other embodiments.

Embodiment 2

Described in Embodiment 2 is a method for displaying an image provided by a digital data file on a display device in which a switching element whose off-state current is reduced is provided in a pixel, using data correlated to an operation of the display device, which is provided by the digital data file. In particular, a standard play mode of a moving image and a simple play mode in which the frequency of refreshings of a display panel is reduced are described below using FIGS. 3 and 7.

In this embodiment, an example in which the data correlated to an operation of the display device is provided by a script file or header data is described.

The composition of a digital data file applied to the display device described in this embodiment is described below. The digital data file used in this embodiment contains a frame compressed in the format decodable independently from the preceding and following frames. Examples of such a format of a digital data file are MPEG2, MPEG4, and H.264. The frame compressed independently from the preceding and following frames, that is, a frame in which only image data is compressed is called a reference frame, an I frame, or an I picture (Intra Picture). In this embodiment, the frame compressed independently from the preceding and following frames is referred to as a reference frame. The digital data file further contains frame(s) in which a difference between the frame and the frame adjacent to the frame is recorded.

In this embodiment, a digital data file recorded in the MP4 file format is used for convenience of the description, as one embodiment of the digital data file containing the reference frame; the process for processing a signal with the image processing circuit 110 is not limited by the MP4 file format.

Figure 7:
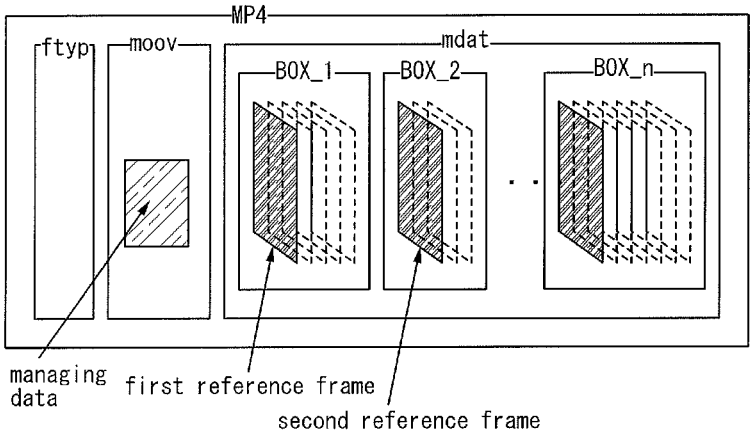
FIG. 7 is a diagram illustrating a file composition for storing an image and data which is correlated to an operation of a display device according to an embodiment.

A conceptual diagram of the file composition of the MP4 file format is FIG. 7. The MP4 file contains a region containing compatible data (a box ftyp), a region in which compressed sound and a compressed moving image are stored (a container box mdat in which media data is stored), and a region in which header data for managing the region is stored (a container box moov in which metadata is stored).

The region (mdat) in which compressed sound and a compressed moving image are stored contains a plurality of regions (boxes or chunks) each containing divided video data and a plurality of regions (boxes or chunks) each containing divided audio data. Each region (box or chunk) containing video data contains at least one reference frame, and contains a plurality of frames in each of which a difference between the frame and the frame adjacent to the frame is recorded.

In the case where the digital data file is compressed using a variable frame rate or a variable bit rate, the number of frames contained in the region (box or chunk) containing divided video data is not constant. Specifically, the number of frames contained in a region (box or chunk) in which an image with a small change between sequential frames is recorded is large, whereas the number of frames contained in a region (box or chunk) in which an image with a large change between sequential frames is recorded is small.

The region (container box moov in which metadata is stored) in which header data for managing the region (box or chunk) in which divided video data is stored is stored contains data on the number of frames N in the region (box or chunk) in which divided video data is stored, data on the frame rate R of the region (box or chunk), and data on the position S of a reference frame.

For example, in FIG. 7, the number of frames $N_1$ in a first region (box or chunk) BOX_1 containing divided video data is 5, and the number of frames $N_2$ in a second region (box or chunk) BOX_2 containing divided video data is 3. The position $S_1$ of a first reference frame contained in the first region (box or chunk) is 1, and the position $S_2$ of a second reference frame contained in the second region (box or chunk) is 6. The number of frames $N_1$ in the first region can be obtained from a difference between $S_2$ and $S_1$.

In the case where the managing data on the first region (box or chunk) BOX_1 containing divided video data includes the number of frames $N_1$ and the frame rate $R_1$, the length of an image stored in the first region can be obtained by multiplying $N_1$ by $R_1$. In this description and the like, the period of time of an image recorded in the region (box or chunk) containing divided video data, which is calculated in such a manner, is referred to as a frame duration.

Next, an operation of outputting image signals to the display panel 120 with the image processing circuit 110 is described below. In the operation of the display device of this embodiment, there are an operation mode in which all of the compressed image signals are decoded to display an image and an operation mode in which a reference frame in the region (box or chunk) containing divided video data is separated by the separation circuit 117 to display an image; the former is called a standard play mode and the latter is called a simple play mode. In the simple play mode, decoding is performed only on the reference frame in this embodiment, so that a load applied to the image processing circuit 110 can be reduced.

First, the standard play mode, that is, an operation in which the image processing circuit 110 decodes all the frames of compressed image signals and outputs the image signals to the display panel 120 is described below.

Users order the separation circuit 117 to start the standard play mode via the input means SW. Then, the decoder 119 decodes the compressed image signals and outputs to the display control circuit 113. The display control circuit 113 outputs the image signals to the display panel 120 in addition to a control signal.

Next, the simple play mode, that is, an operation in which the image processing circuit 110 decodes only a reference frame chose from frames of the compressed image signals and outputs to the display panel 120 is described below.

Users order the separation circuit 117 to start the simple play mode via the input means SW. The separation circuit 117 separates the first reference frame from the first region (box or chunk) BOX_1 containing divided video data of compressed image signals. Next, the separation circuit 117 decodes the first reference frame to generate a first image for one frame and outputs to the display control circuit 113. The position of the first reference frame may be specified using managing data on the position S of the reference frame to separate the first reference frame.

The display control circuit 113 also searches the container box moov containing metadata in the memory circuit 116, so that a product of multiplication of the number of frames $N_1$ and the frame rate $R_1$ of the first region (box or chunk) containing divided video data is obtained, thereby calculating a period of time of an image recorded in the first region (box or chunk), that is, a first frame duration.

The display control circuit 113 outputs the first image for one frame to the display panel 120 in addition to the control signal, and stands by during the first frame duration. Accordingly, the display panel 120 keeps displaying the first image generated from the first reference frame, during the first frame duration.

The separation circuit 117 separates the second reference frame from the second region (box or chunk) BOX_2 containing divided video data and next to the first region (box or chunk) BOX_1, so that a second image is prepared. Further, the display control circuit 113 calculates a period of time of an image recorded in the second region (box or chunk), that is, a second frame duration.

After the first frame duration passes by, the display control circuit 113 outputs the second image prepared by the separation circuit 117 to the display panel 120, and stands by during the second frame duration. Accordingly, the display panel 120 keeps displaying the second image generated from the second reference frame, during the second frame duration.

The operation in which a reference frame is separated from the region (box or chunk) containing divided video data of compressed images and an image of the reference frame is displayed is repeated, so that the compressed images can be displayed with simplification.

According to the above-described method, not all of the compressed image signals need to be decoded. Accordingly, an operation load of the image processing circuit 110 is decreased, and power consumption of the display device 100 can be reduced.

The image processing circuit described in this embodiment may have a mode-switching function. The mode-switching function enables users of the display device to select an operation mode of the display device manually or with use of an external connection device from a standard play mode, a simple play mode, and stop of display.

The separation circuit 117 can output the image signal to the display control circuit 113 in accordance with a signal input from the mode-switching circuit.

According to the display device of this embodiment, the operation frequency of the decoder provided for the image processing circuit can be reduced. Consequently, not only power consumption of the display element at the time of rewriting but also power consumption of the image processing circuit can be decreased.

The kind of display elements does not give any limitation on the effect of reduction of the power consumption of the image processing circuit; specifically, even in a display device using electroluminescence instead of a liquid crystal element, power consumption of the image processing circuit described in this embodiment can be reduced.

Further, in the case where the same images are rewritten a plurality of times to display a still image, visual recognition of switching between images might cause eyestrain. According to the display device of this embodiment, the writing frequency of an image signal is reduced, which also leads to less severe eyestrain.

In particular, according to the display device of this embodiment, transistors whose off-state current is reduced are applied to pixels and a switching transistor of a common electrode, whereby the period of time during which a voltage can be held by a holding capacitor can be prolonged.

Embodiment 2 can be implemented in appropriate combination with any other structure described in the other embodiments.

Embodiment 3

In Embodiment 3, one example of a transistor which can be applied to the display device disclosed in this description and the like will be described. There is no particular limitation on a structure of the transistor which can be applied to a display device disclosed in this description and the like; for example, a top-gate structure or a bottom-gate structure such as a staggered type or a planar type can be used. Further, the transistor may have a single gate structure including one channel formation region, a double gate structure including two channel formation regions, or a triple gate structure including three channel formation regions. Alternatively, the transistor may have a dual gate structure including two gate electrode layers positioned over and below a channel region with a gate insulating layer provided therebetween. Note that examples of a cross-sectional structure of a transistor illustrated FIGS. 8A to 8D are described below. Transistors illustrated in FIGS. 8A to 8D are transistors including an oxide semiconductor as a semiconductor. An oxide semiconductor provides an advantage in that high mobility and low off-state current can be obtained in a relatively easy and low-temperature process: however, it is needless to say that another semiconductor may be used.

Figure 8A:
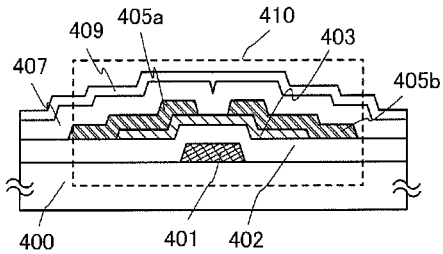
FIGS. 8A to 8D are cross-sectional views of transistors according to an embodiment.

A transistor 410 illustrated in FIG. 8A is a kind of bottom-gate transistor and is also called an inverted staggered transistor.

The transistor 410 includes, over a substrate 400 having an insulating surface, a gate electrode layer 401, a gate insulating layer 402, an oxide semiconductor layer 403, a source electrode layer 405*a*, and a drain electrode layer 405*b*. An insulating layer 407 is provided to cover the transistor 410 and be stacked over the oxide semiconductor layer 403. A protective insulating layer 409 is formed over the insulating layer 407.

Figure 8B:
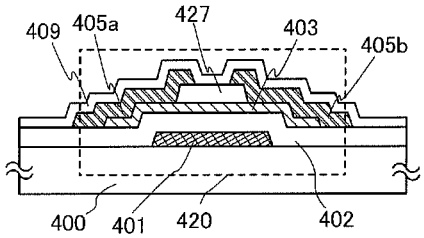

A transistor 420 illustrated in FIG. 8B is a kind of bottom-gate structure referred to as a channel-protective type (channel-stop type) and is also referred to as an inverted staggered transistor.

The transistor 420 includes, over a substrate 400 having an insulating surface, a gate electrode layer 401, a gate insulating layer 402, an oxide semiconductor layer 403, an insulating layer 427 which functions as a channel protective layer covering a channel formation region of the oxide semiconductor layer 403, a source electrode layer 405*a*, and a drain electrode layer 405*b*. A protective insulating layer 409 is provided to cover the transistor 420.

Figure 8C:
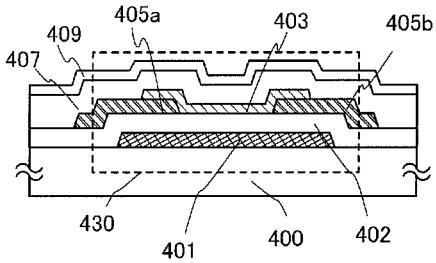

A transistor 430 illustrated in FIG. 8C is a bottom-gate transistor and includes, over a substrate 400 having an insulating surface, a gate electrode layer 401, a gate insulating layer 402, a source electrode layer 405*a*, a drain electrode layer 405*b*, and an oxide semiconductor layer 403. An insulating layer 407 is provided to cover the transistor 430 and be in contact with the oxide semiconductor layer 403. A protective insulating layer 409 is formed over the insulating layer 407.

In the transistor 430, the gate insulating layer 402 is provided on and in contact with the substrate 400 and the gate electrode layer 401, and the source electrode layer 405*a* and the drain electrode layer 405*b* are provided on and in contact with the gate insulating layer 402. The oxide semiconductor layer 403 is provided over the gate insulating layer 402, the source electrode layer 405*a*, and the drain electrode layer 405*b*.

Figure 8D:
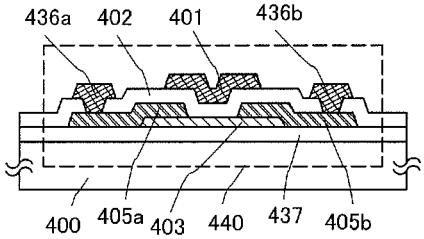

A transistor 440 illustrated in FIG. 8D is a kind of top-gate transistor. The transistor 440 includes, over a substrate 400 having an insulating surface, an insulating layer 437, an oxide semiconductor layer 403, a source electrode layer 405*a*, a drain electrode layer 405*b*, a gate insulating layer 402, and a gate electrode layer 401. A wiring layer 436*a* and a wiring layer 436*b* are provided to be in contact with and electrically connected to the source electrode layer 405*a* and the drain electrode layer 405*b*, respectively.

In this embodiment, as described above, the oxide semiconductor layer 403 is used as a semiconductor layer. As an oxide semiconductor used for the oxide semiconductor layer 403, the following can be used: an In—Sn—Ga—Zn—O-based oxide semiconductor which is an oxide of four metal elements; an In—Ga—Zn—O-based oxide semiconductor, an In—Sn—Zn—O-based oxide semiconductor, an In—Al—Zn—O-based oxide semiconductor, a Sn—Ga—Zn—O-based oxide semiconductor, an Al—Ga—Zn—O-based oxide semiconductor, or a Sn—Al—Zn—O-based oxide semiconductor which are oxides of three metal elements; an In—Zn—O-based oxide semiconductor, a Sn—Zn—O-based oxide semiconductor, an Al—Zn—O-based oxide semiconductor, a Zn—Mg—O-based oxide semiconductor, a Sn—Mg—O-based oxide semiconductor, or an In—Mg—O-based oxide semiconductor which are oxides of two metal elements; or an In—O-based oxide semiconductor, a Sn—O-based oxide semiconductor, a Zn—O-based oxide semiconductor, or the like. Silicon oxide may be added to any of the above oxide semiconductors. Addition of silicon oxide ($SiO_x$ (x>0)) which hinders crystallization into the oxide semiconductor layer can suppress crystallization of the oxide semiconductor layer at the time when heat treatment is performed after formation of the oxide semiconductor layer in the manufacturing process. In this embodiment, for example, the In—Ga—Zn—O-based oxide semiconductor means an oxide containing at least In, Ga, and Zn, and the composition ratio of the elements is not particularly limited. The In—Ga—Zn—O-based oxide semiconductor may contain an element other than In, Ga, and Zn.

As the above oxide semiconductor layer 403, a thin film represented by $InMO_3(ZnO)_m$ (m>0 and in is not a natural number) can be used. In this embodiment, M represents one or more metal elements selected from Ga, Al, Mn, and Co. For example, M corresponds to Ga, Ga and Al, Ga and Mn, Ga and Co, or the like.

In each of the transistors 410, 420, 430, and 440 including the oxide semiconductor layer 403, the current in an off state (the off-state current) can be small. Thus, the retention time for an electric signal such as image data can be extended, and an interval between writings can be extended. Accordingly, frequency of refresh operation can be reduced, which leads to suppression of power consumption.

Further, in the transistors 410, 420, 430, and 440 including the oxide semiconductor layer 403, relatively high field-effect mobility can be obtained, which enables high-speed operation. Accordingly, by using the transistor in a pixel portion of the display device, color separation can be suppressed and a high-quality image can be displayed. Since the transistors can be separately formed over one substrate in a circuit portion and a pixel portion, the number of components can be reduced in a liquid crystal display device.

Although there is no particular limitation on a substrate used for the substrate 400 having an insulating surface, a glass substrate of barium borosilicate glass, aluminoborosilicate glass, or the like is used.

In the bottom-gate transistors 410, 420, and 430, an insulating film serving as a base film may be provided between the substrate and the gate electrode layer. The base film prevents diffusion of an impurity element from the substrate, and can be formed to have a single-layer structure or a stacked-layer structure using one or more of a silicon nitride film, a silicon oxide film, a silicon nitride oxide film, and a silicon oxynitride film.

The gate electrode layer 401 can be formed to have a single-layer structure or a stacked-layer structure using a metal material such as molybdenum, titanium, chromium, tantalum, tungsten, aluminum, copper, neodymium, or scandium, or an alloy material which contains any of these materials as its main component.

The gate insulating layer 402 can be formed to have a single-layer structure or a layered-layer structure using one or more of a silicon oxide layer, a silicon nitride layer, a silicon oxynitride layer, a silicon nitride oxide layer, an aluminum oxide layer, an aluminum nitride layer, an aluminum oxynitride layer, an aluminum nitride oxide layer, and a hafnium oxide layer by a plasma CVD method, a sputtering method, or the like. For example, by a plasma CVD method, a silicon nitride layer ($SiN_y$ (y>0)) with a thickness of greater than or equal to 50 nm and less than or equal to 200 nm is formed as a first gate insulating layer, and a silicon oxide layer ($SiO_x$ (x>0)) with a thickness of greater than or equal to 5 nm and less than or equal to 300 nm is formed as a second gate insulating layer over the first gate insulating layer, so that a gate insulating layer with a total thickness of 200 nm is formed.

As a conductive film used for the source electrode layer 405*a* and the drain electrode layer 405*b*, for example, a film of an element selected from Al, Cr, Cu, Ta, Ti, Mo, and W, a film of an alloy containing any of these elements as a component, an alloy film containing these elements in combination, or the like can be used. Alternatively, a structure may be employed in which a high-melting-point metal layer of Ti, Mo, W, or the like is stacked over and/or below a metal layer of Al, Cu, or the like. In addition, heat resistance can be improved by using an Al material to which an element (Si, Nd, Sc, or the like) which prevents generation of a hillock or a whisker in an Al film is added.

A material similar to that of the source electrode layer 405*a* and the drain electrode layer 405*b* can be used for a conductive film such as the wiring layer 436*a* and the wiring layer 436*b* which are connected to the source electrode layer 405*a* and the drain electrode layer 405*b*, respectively.

Alternatively, the conductive film which serves as the source electrode layer 405*a* and the drain electrode layer 405*b* (including a wiring formed using the same layer as the source electrode layer 405*a* and the drain electrode layer 405*b*) may be formed using a conductive metal oxide. As the conductive metal oxide, indium oxide ($In_2O_3$), tin oxide ($SnO_2$), zinc oxide (ZnO), indium oxide-tin oxide alloy ($In_2O_3$—$SnO_2$, which is abbreviated to ITO), indium oxide-zinc oxide alloy ($In_2O_3$—ZnO), or any of these metal oxide materials in which silicon oxide is contained can be used.

As the insulating layers 407, 427, and 437, typically, an inorganic insulating film such as a silicon oxide film, a silicon oxynitride film, an aluminum oxide film, or an aluminum oxynitride film can be used.

As the protective insulating layer 409, an inorganic insulating film such as a silicon nitride film, an aluminum nitride film, a silicon nitride oxide film, or an aluminum nitride oxide film can be used.

A planarization insulating film may be formed over the protective insulating layer 409 in order to reduce surface roughness due to a transistor. As the planarization insulating film, an organic material such as polyimide, acrylic, or benzocyclobutene can be used. As well as such organic materials, it is possible to use a low-dielectric constant material (a low-k material) or the like. The planarization insulating film may be formed by stacking a plurality of insulating films formed from these materials.

Thus, in this embodiment, a high-performance display device can be provided by using a transistor including an oxide semiconductor layer.

With the transistor whose off-state current is reduced and including an oxide semiconductor layer, electric charge stored in the display element connected to the transistor and the capacitor does not leak so much through the transistor in the off-state and the data written before the transistor is turned off can be kept for a long period of time.

Embodiment 4

In Embodiment 4, an example of a transistor including an oxide semiconductor layer, and an example of a manufacturing method thereof will be described in detail using FIGS. 9A to 9E. The above embodiments can be applied to the same portions as or portions or steps having functions similar to those in the above embodiments, and repetitive description is omitted.

FIGS. 9A to 9E illustrate an example of a cross-sectional structure of a transistor. A transistor 510 illustrated in FIGS. 9A to 9E is a bottom-gate inverted-staggered transistor which is similar to the transistor 410 illustrated in FIG. 8A.

An oxide semiconductor used for a semiconductor layer in this embodiment is an i-type (intrinsic) oxide semiconductor or a substantially i-type (intrinsic) oxide semiconductor, which is obtained in such a manner that hydrogen, which is an n-type impurity, is removed from an oxide semiconductor, and the oxide semiconductor is highly purified so as to contain as few impurities that are not main components of the oxide semiconductor as possible. In other words, the oxide semiconductor according to the present invention features in that it is made to be an i-type (intrinsic) semiconductor or made to be close thereto not by addition of an impurity but by highly purifying by removal of an impurity such as hydrogen or water as much as possible. Therefore, the oxide semiconductor layer included in the transistor 510 is an oxide semiconductor layer which is highly purified and made to be electrically i-type (intrinsic).

The number of carriers in the highly purified oxide semiconductor is very small (close to zero), and the carrier concentration is less than $1\times10^{14}/cm^3$, preferably less than $1\times10^{12}/cm^3$, far preferably less than $1\times10^{11}/cm^2$.

Since the number of carriers in the oxide semiconductor layer is extremely small, the off-state current of the transistor can be reduced. The smaller the amount of off-state current is, the better.

Specifically, in the transistor including the oxide semiconductor layer, off-state current density per micrometer in a channel width at room temperature can be reduced to less than or equal to 10 aA/μm ($1\times10^{-17}$ A/μm), further less than or equal to 1 aA/μm ($1\times10^{-18}$ A/μm), or still further less than or equal to 10 zA/μm ($1\times10^{-20}$ A/μm).

With the transistor whose current value in an off-state (off-state-current value) is extremely small used as a transistor in the pixel portion of Embodiment 2, refresh operation in a still image region can be performed with a small number of times of writings of image data.

In addition, in the transistor 510 including the oxide semiconductor layer, the temperature dependence of the on-state current is hardly observed, and off-state current remains extremely small.

Steps of manufacturing the transistor 510 over a substrate 505 are described below using FIGS. 9A to 9E.

First, a conductive film is formed over the substrate 505 having an insulating surface and then is subjected to a first photolithography step, so that a gate electrode layer 511 is formed. A resist mask may be formed by an inkjet method. Formation of the resist mask by an inkjet method needs no photomask; thus, manufacturing cost can be reduced.

As the substrate 505 having an insulating surface, a substrate similar to the substrate 400 described in Embodiment 3 can be used. In this embodiment, a glass substrate is used as the substrate 505.

An insulating film serving as a base film may be provided between the substrate 505 and the gate electrode layer 511. The base film prevents diffusion of an impurity element from the substrate 505, and can be formed to have a single-layer structure or a stacked-layer structure using one or more of a silicon nitride film, a silicon oxide film, a silicon nitride oxide film, and a silicon oxynitride film.

In addition, the gate electrode layer 511 can be formed to have a single-layer structure or a stacked-layer structure using a metal material such as molybdenum, titanium, tantalum, tungsten, aluminum, copper, neodymium, or scandium, or an alloy material which contains any of these materials as its main component.

Next, a gate insulating layer 507 is formed over the gate electrode layer 511. The gate insulating layer 507 can be formed to have a single-layer structure or a stacked-layer structure using one or more of a silicon oxide layer, a silicon nitride layer, a silicon oxynitride layer, a silicon nitride oxide layer, an aluminum oxide layer, an aluminum nitride layer, an aluminum oxynitride layer, an aluminum nitride oxide layer, and a hafnium oxide layer, by a plasma CVD method, a sputtering method, or the like.

As the oxide semiconductor in this embodiment, an i-type or substantially i-type oxide semiconductor which is made by removing impurities is used. Such a highly purified oxide semiconductor is highly sensitive to an interface state and interface charge; thus, an interface between the oxide semiconductor layer and the gate insulating layer is important. For that reason, the gate insulating layer that is to be in contact with the highly-purified oxide semiconductor needs to have high quality.

For example, a high-density plasma CVD method using microwaves (e.g., a frequency of 2.45 GHz) is preferably adopted because an insulating layer can be formed to be dense and have high withstand voltage and high quality. This is because the highly-purified oxide semiconductor and the high-quality gate insulating layer are in close contact with each other, whereby the interface state density can be reduced to provide high interface characteristics.

Needless to say, another film formation method such as a sputtering method or a plasma CVD method can be employed as long as the method enables formation of a high-quality insulating layer as a gate insulating layer. Alternatively, or in addition, an insulating layer whose film quality and characteristic of the interface between the insulating layer and an oxide semiconductor are improved by heat treatment which is performed after formation of the insulating layer may be used as a gate insulating layer. In any case, any insulating layer can be used as long as the insulating layer which can reduce the interface state density of the interface with an oxide semiconductor and form a favorable interface in addition to having high film quality as a gate insulating layer.

Further, in order that hydrogen, a hydroxyl group, and moisture could be contained in the gate insulating layer 507 and an oxide semiconductor film 530 as little as possible, it is preferable that the substrate 505 provided with the gate electrode layer 511 or the substrate 505 provided with the elements up to and including the gate insulating layer 507 be preheated in a preheating chamber of a sputtering apparatus as pretreatment for deposition of the oxide semiconductor film 530 so that impurities such as hydrogen and moisture adsorbed to the substrate 505 are eliminated and exhaustion is performed. As an exhaustion unit provided in the preheating chamber, a cryopump is preferable. This preheating treatment is not necessarily performed. This preheating process may be similarly performed on the substrate 505 provided with the elements up to and including a source electrode layer 515*a* and a drain electrode layer 515*b* before deposition of an insulating layer 516.

Figure 9A:
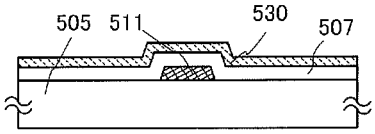
FIGS. 9A to 9E are cross-sectional views illustrating a manufacturing process of a transistor according to an embodiment.
Figure 9B:
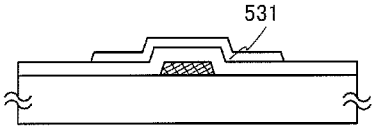

Next, the oxide semiconductor film 530 having a thickness of greater than or equal to 2 nm and less than or equal to 200 nm, preferably greater thane or equal to 5 nm and less than or equal to 30 nm is formed over the gate insulating layer 507 (see FIG. 9A).

Note that before the oxide semiconductor film 530 is formed by a sputtering method, powder substances (also referred to as particles or dust) attached on a surface of the gate insulating layer 507 are preferably removed by reverse sputtering in which an argon gas is introduced and plasma is generated. The reverse sputtering refers to a method in which, without application of a voltage to a target side, an RF power supply is used for application of a voltage to a substrate side in an argon atmosphere to modify a surface. Instead of an argon atmosphere, a nitrogen atmosphere, a helium atmosphere, an oxygen atmosphere, or the like may be used.

As an oxide semiconductor used for the oxide semiconductor film 530, any oxide semiconductor described in Embodiment 3, such as an oxide of four metal elements, an oxide of three metal elements, an oxide of two metal elements, an In—O-based oxide semiconductor, a Sn—O-based oxide semiconductor, or a Zn—O-based oxide semiconductor can be used. Further, $SiO_2$ may be contained in the above oxide semiconductor. In this embodiment, the oxide semiconductor film 530 is deposited by a sputtering method with the use of an In—Ga—Zn—O-based oxide semiconductor target. A cross-sectional view at this stage is FIG. 9A. The oxide semiconductor film 530 can be formed by a sputtering method in a rare gas (typically, argon) atmosphere, an oxygen atmosphere, or a mixed atmosphere of a rare gas and oxygen.

As a target for depositing the oxide semiconductor film 530 by a sputtering method, for example, a target having a composition ratio of $In_2O_3$:$Ga_2O_3$:ZnO=1:1:1 [mol %] (that is, In:Ga:Zn=1:1:0.5 [atom %]), or the like can be used. Alternatively, a target having a composition ratio of In:Ga:Zn=1:1:1 [atom %] or In:Ga:Zn=1:1:2 [atom %] may be used. The filling rate of the metal oxide target is greater than or equal to 90% and less than or equal to 100%, preferably greater than or equal to 95% and less than or equal to 99.9%. With use of a metal oxide target with high filling rate, the deposited oxide semiconductor film has high density.

It is preferable that a high-purity gas in which an impurity such as hydrogen, water, a hydroxyl group, or hydride is removed be used as the sputtering gas for the deposition of the oxide semiconductor film 530.

The substrate is placed in a deposition chamber under reduced pressure, and the substrate temperature is set to a temperature higher than or equal to 100° C. and lower than or equal to 600° C., preferably higher than or equal to 200° C. and lower than or equal to 400° C. By depositing the oxide semiconductor film while the substrate is heated, the concentration of impurities included in the oxide semiconductor film can be reduced. In addition, damage by sputtering can be reduced. Then, residual moisture in the deposition chamber is removed, a sputtering gas from which hydrogen and moisture are removed is introduced, and the above-described target is used, so that the oxide semiconductor film 530 is formed over the substrate 505. In order to remove the residual moisture in the deposition chamber, an entrapment vacuum pump, for example, a cryopump, an ion pump, or a titanium sublimation pump is preferably used. The evacuation unit may be a turbo pump provided with a cold trap. In the deposition chamber which is evacuated with the cryopump, a hydrogen atom, a compound containing a hydrogen atom, such as water ($H_2O$), (more preferably, also a compound containing a carbon atom), and the like are removed, whereby the concentration of an impurity in the oxide semiconductor film deposited in the deposition chamber can be reduced.

As one example of the deposition condition, the distance between the substrate and the target is 100 mm, the pressure is 0.6 Pa, the direct-current (DC) power is 0.5 kW, and the atmosphere is an oxygen atmosphere (the proportion of the oxygen flow rate is 100%). It is preferable to use a pulse direct current power supply because powder substances (also referred to as particles or dust) generated in the deposition can be reduced and the film thickness can be uniform.

Next, the oxide semiconductor film 530 is processed into an island-shaped oxide semiconductor layer by a second photolithography step. A resist mask for forming the island-shaped oxide semiconductor layer may be formed by an inkjet method. Formation of the resist mask by an inkjet method needs no photomask; thus, manufacturing cost can be reduced.

In the case where a contact hole is formed in the gate insulating layer 507, a step of forming the contact hole can be performed at the same time as the processing of the oxide semiconductor film 530.

For the etching of the oxide semiconductor film 530 in this embodiment, either one or both of wet etching and dry etching may be employed. As an etchant used for wet etching of the oxide semiconductor film 530, for example, a mixed solution of phosphoric acid, acetic acid, and nitric acid, or the like can be used. ITO07N (produced by KANTO CHEMICAL CO., INC.) may be used as well.

Next, the oxide semiconductor layer is subjected to first heat treatment. The oxide semiconductor layer can be dehydrated or dehydrogenated by this first heat treatment. The temperature of the first heat treatment is higher than or equal to 400° C. and lower than or equal to 750° C., or higher than or equal to 400° C. and lower than the strain point of the substrate. In this embodiment, the substrate is put in an electric furnace which is a kind of heat treatment apparatus and heat treatment is performed on the oxide semiconductor layer at 450° C. for one hour in a nitrogen atmosphere, and then, the oxide semiconductor layer is prevented from being exposed to the air so that water or hydrogen is prevented from entering the oxide semiconductor layer; in this manner, an oxide semiconductor layer 531 is obtained (see FIG. 9B).

The heat treatment apparatus is not limited to an electrical furnace, and may have a device for heating an object by heat conduction or heat radiation from a heating element such as a resistance heating element. For example, an RTA (rapid thermal anneal) apparatus such as a GRTA (gas rapid thermal anneal) apparatus or an LRTA (lamp rapid thermal anneal) apparatus can be used. An LRTA apparatus is an apparatus for heating an object by radiation of light (an electromagnetic wave) emitted from a lamp such as a halogen lamp, a metal halide lamp, a xenon arc lamp, a carbon arc lamp, a high pressure sodium lamp, or a high pressure mercury lamp. A GRTA apparatus is an apparatus for heat treatment using a high-temperature gas. As the high-temperature gas, an inert gas which does not react with an object by heat treatment, such as nitrogen or a are gas like argon, is used.

For example, as the first heat treatment, GRTA may be performed, according to which the substrate is moved into an inert gas heated to a temperature as high as 650° C. to 700° C., heated for several minutes, and moved out of the inert gas heated to the high temperature.

In the first heat treatment, it is preferable that water, hydrogen, and the like be not contained in the atmosphere of nitrogen or a rare gas such as helium, neon, or argon. The purity of nitrogen or the rare gas such as helium, neon, or argon which is introduced into a heat treatment apparatus is preferably set to be 6N (99.9999%) or higher, far preferably 7N (99.99999%) or higher (that is, the impurity concentration is preferably 1 ppm or lower, far preferably 0.1 ppm or lower).

Further, after the oxide semiconductor layer is heated in the first heat treatment, a high-purity oxygen gas, a high-purity $N_2O$ gas, or an ultra-dry air (the dew point is lower than or equal to −40° C., preferably lower than or equal to −60° C.) may be introduced into the same furnace. It is preferable that water, hydrogen, and the like be not contained in the oxygen gas or $N_2O$ gas. The purity of the oxygen gas or the $N_2O$ gas which is introduced into the heat treatment apparatus is preferably 6N or more, far preferably 7N or more (that is, the concentration of an impurity in the oxygen gas or the $N_2O$ gas is preferably 1 ppm or lower, far preferably 0.1 ppm or lower). The oxygen gas or the $N_2O$ gas acts to supply oxygen that is a main component of the oxide semiconductor and is reduced by the step for removing impurities by dehydration or dehydrogenation, so that the oxide semiconductor layer is made to be a highly-purified and electrically i-type (intrinsic) oxide semiconductor.

The first heat treatment of the oxide semiconductor layer can be performed on the oxide semiconductor film 530 before being processed into the island-shaped oxide semiconductor layer. In that case, the substrate is taken out from the heat apparatus after the first heat treatment, and then a photolithography step is performed thereon.

The first heat treatment may be performed at any of the following timings without being limited to the above timing as long as it is after deposition of the oxide semiconductor layer: after a source electrode layer and a drain electrode layer are formed over the oxide semiconductor layer; after an insulating layer is formed over the source electrode layer and the drain electrode layer.

Further, in the case where a contact hole is formed in the gate insulating layer 507, a step of forming the contact hole may be performed before or after the first heat treatment is performed on the oxide semiconductor film 530.

In addition, as the oxide semiconductor layer, an oxide semiconductor layer having a crystal region which is c-axis-aligned perpendicularly to a surface of the film may be formed by performing deposition twice and heat treatment twice, regardless of material of a base member. For example, a first oxide semiconductor film with a thickness greater than or equal to 3 nm and less than or equal to 15 nm is deposited, and first heat treatment is performed in a nitrogen, an oxygen, a rare gas, or a dry air atmosphere at a temperature higher than or equal to 450° C. and lower than or equal to 850° C., preferably higher than or equal to 550° C. and lower than or equal to 750° C., so that a first oxide semiconductor film having a crystal region (including a plate-like crystal) in a region including a surface is formed. Then, a second oxide semiconductor film which has a larger thickness than the first oxide semiconductor film is formed, and second heat treatment is performed at a temperature higher than or equal to 450° C. and lower than or equal to 850° C., preferably higher than or equal to 600° C. and lower than or equal to 700° C., so that crystal growth proceeds upward with the use of the first oxide semiconductor film as a seed of the crystal growth and the whole second oxide semiconductor film is crystallized. In such a manner, the oxide semiconductor layer having a crystal region having a large thickness may be formed.

Next, a conductive film serving as the source and drain electrode layers (including a wiring formed of the same layer as the source and drain electrode layers) is formed over the gate insulating layer 507 and the oxide semiconductor layer 531. As the conductive film serving as the source and drain electrode layers, the material used for the source electrode layer 405*a* and the drain electrode layer 405*b* which is described in Embodiment 3 can be used.

Figure 9C:
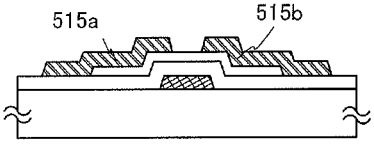

A resist mask is formed over the conductive film by a third photolithography step, and selectively etched to form the source electrode layer 515*a* and the drain electrode layer 515*b*, and then, the resist mask is removed (see FIG. 9C).

Light exposure at the time of the formation of the resist mask in the third photolithography step may be performed using ultraviolet light, KrF laser light, or ArF laser light. A channel length L of a transistor is determined by a pitch between bottom end portions of the source electrode layer and the drain electrode layer, which are adjacent to each other over the oxide semiconductor layer 531. In the case where light exposure is performed for a channel length L of less than 25 nm, the light exposure at the time of the formation of the resist mask in the third photolithography step is preferably performed using extreme ultraviolet light having an extremely short wavelength of several nanometers to several tens of nanometers. In the light exposure by extreme ultraviolet light, the resolution is high and the focus depth is large. Therefore, the channel length L of the transistor can be longer than or equal to 10 nm and shorter than or equal to 1000 nm, which can increase operation speed of a circuit, and power consumption can be reduced because the off-state current is extremely small. In order to reduce the number of photomasks used in a photolithography step and reduce the number of photolithography steps, the etching step may be performed with the use of a multi-tone mask which is a photomask through which light is transmitted to have a plurality of intensities. A resist mask formed with the use of a multi-tone mask has a plurality of thicknesses and further can be changed in shape by etching; therefore, the resist mask can be used in a plurality of etching steps for processing into different patterns. Therefore, a resist mask corresponding to at least two kinds of different patterns can be formed by one multi-tone mask. Thus, the number of photomasks can be reduced and the number of photolithography steps can be accordingly reduced, which enables simplification of a manufacturing process.

Note that it is preferable that etching conditions be optimized so as not to etch and divide the oxide semiconductor layer 531 when the conductive film is etched. However, it is difficult to obtain etching conditions in which only the conductive film is etched away and the oxide semiconductor layer 531 is not etched at all; in some cases, only part of the oxide semiconductor layer 531 is etched away by the etching of the conductive film so as to be a depressed portion.

In this embodiment, since the Ti film is used as the conductive film and the In—Ga—Zn—O-based oxide semiconductor is used as the oxide semiconductor layer 531, ammonia hydrogen peroxide (a mixed solution of ammonia, water, and hydrogen peroxide) is used as an etchant for etching the conductive film.

Next, plasma treatment using a gas of $N_2O$, $N_2$, or Ar, may be performed to remove water or the like adsorbed to a surface of an exposed portion of the oxide semiconductor layer. In the case where the plasma treatment is performed, the insulating layer 516 is formed without exposure to the air as a protective insulating film in contact with part of the oxide semiconductor layer.

The insulating layer 516 can be formed to a thickness of at least 1 nm by a method by which an impurity such as water or hydrogen does not enter the insulating layer 516, such as a sputtering method as appropriate. When hydrogen is contained in the insulating layer 516, entry of the hydrogen to the oxide semiconductor layer, or extraction of oxygen in the oxide semiconductor layer by hydrogen may occur, thereby causing the backchannel of the oxide semiconductor layer to have lower resistance (to be n-type), so that a parasitic channel might be formed. Therefore, it is important that a deposition method in which hydrogen is not used is employed in order to form the insulating layer 516 containing as little hydrogen as possible.

In this embodiment, a silicon oxide film is formed to a thickness of 200 nm as the insulating layer 516 by a sputtering method. The substrate temperature in the film deposition may be higher than or equal to room temperature and lower than or equal to 300° C. and is 100° C. in this embodiment. The silicon oxide film can be deposited by a sputtering method in a rare gas (typically, argon) atmosphere, an oxygen atmosphere, or a mixed atmosphere containing a rare gas and oxygen. As a target, a silicon oxide target or a silicon target may be used. For example, the silicon oxide film can be formed using a silicon target by a sputtering method in an atmosphere containing oxygen. As the insulating layer 516 which is formed in contact with the oxide semiconductor layer, an inorganic insulating film which does not include impurities such as moisture, a hydrogen ion, and OH" and blocks entry of these from the outside is used; typically, a silicon oxide film, a silicon oxynitride film, an aluminum oxide film, an aluminum oxynitride film, or the like is used.

In order to remove residual moisture in the deposition chamber of the insulating layer 516 at the same time as deposition of the oxide semiconductor film 530, an entrapment vacuum pump (such as a cryopump) is preferably used. When the insulating layer 516 is deposited in the deposition chamber evacuated using a cryopump, the impurity concentration in the insulating layer 516 can be reduced. In addition, as an exhaustion unit for removing the residual moisture in the deposition chamber of the insulating layer 516, a turbo pump provided with a cold trap may be used.

It is preferable that a high-purity gas in which an impurity such as hydrogen, water, a hydroxyl group, or hydride is removed be used as the sputtering gas for the deposition of the insulating layer 516.

Next, a second heat treatment is performed in an inert gas atmosphere or oxygen gas atmosphere (preferably at a temperature higher than or equal to 200° C. and lower than or equal to 400° C., for example, higher than or equal to 250° C. and lower than or equal to 350° C.). For example, the second heat treatment is performed in a nitrogen atmosphere at 250° C. for one hour. In the second heat treatment, part of the oxide semiconductor layer (a channel formation region) is heated while being in contact with the insulating layer 516.

Through the above process, the first heat treatment is performed on the oxide semiconductor film so that an impurity such as hydrogen, moisture, a hydroxyl group, or hydride (also referred to as a hydrogen compound) is removed from the oxide semiconductor layer, and oxygen which is one of main components of an oxide semiconductor and is reduced in the step of removing impurities can be supplied. Accordingly, the oxide semiconductor layer is highly purified to be an electrically i-type (intrinsic) semiconductor.

Figure 9D:
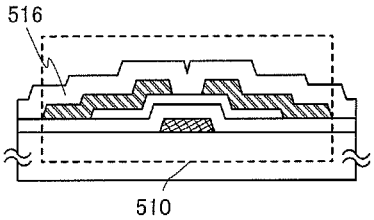
Figure 9E:
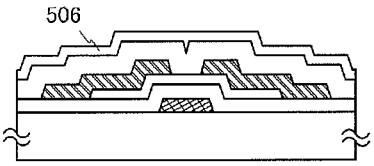

Through the above process, the transistor 510 is formed (FIG. 9D).

When a silicon oxide layer having a lot of defects is used as the oxide insulating layer, by heat treatment after formation of the silicon oxide layer, an impurity such as hydrogen, moisture, a hydroxyl group, or hydride included in the oxide semiconductor layer is diffused to the oxide insulating layer, so that the impurity in the oxide semiconductor layer can be further reduced.

A protective insulating layer 506 may be formed over the insulating layer 516. For example, a silicon nitride film is formed by an RF sputtering method. Since an RF sputtering method has high productivity, it is preferably used as a film formation method of the protective insulating layer. As the protective insulating layer, an inorganic insulating film which does not include an impurity such as moisture and prevents entry of these from the outside, such as a silicon nitride film or an aluminum nitride film is used. In this embodiment, the protective insulating layer 506 is formed using a silicon nitride film as a protective insulating layer (see FIG. 9E).

In this embodiment, as the protective insulating layer 506, a silicon nitride film is formed by heating the substrate 505 provided with the elements up to and including the insulating layer 516, to a temperature of 100° C. to 400° C., introducing a sputtering gas containing high-purity nitrogen from which hydrogen and moisture are removed, and using a target of a silicon semiconductor. In that case also, the protective insulating layer 506 is preferably deposited removing residual moisture in a treatment chamber, similarly to the insulating layer 516.

After the formation of the protective insulating layer, heat treatment may be further performed at a temperature higher than or equal to 100° C. and lower than or equal to 200° C. in the air for a period longer than or equal to 1 hour and shorter than or equal to 30 hours. This heat treatment may be performed at a fixed heating temperature. Alternatively, the following change in the heating temperature may be conducted plural times repeatedly: the heating temperature is increased from room temperature to a temperature of higher than or equal to 100° C. and lower than or equal to 200° C. and then decreased to room temperature.

In this manner, with the use of the transistor including a highly-purified oxide semiconductor layer manufactured using this embodiment, the current value in an off state (an off-state current) can be further reduced. Thus, the retention time for an electric signal such as image data can be extended, and an interval between writings can be extended. Accordingly, the frequency of refreshings can be reduced, which leads to more suppression of power consumption.

In addition, the transistor including a highly-purified oxide semiconductor layer has high field-effect mobility, which enables high-speed operation. Accordingly, by using the transistor in a pixel portion of a display device, a high-quality image can be displayed. Since the transistors can be separately formed over one substrate in a circuit portion and a pixel portion, the number of components can be reduced in the display device.

Embodiment 4 can be implemented in appropriate combination with any other structure described in the other embodiments.

Embodiment 5

In Embodiment 5, examples of electronic devices each including the display device described in the above embodiment will be described.

Figure 10A:
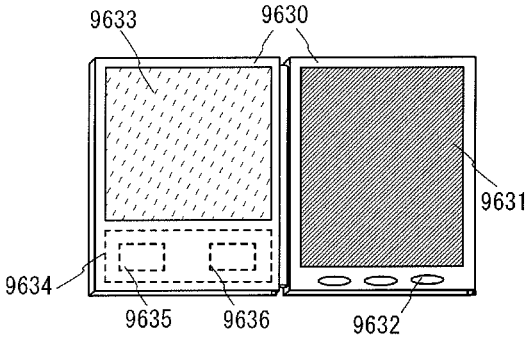
FIGS. 10A and 10B are diagrams illustrating an example of an electronic device having a display device according to an embodiment.

FIG. 10A illustrates an electronic book reader (also referred to as an e-book reader) which can include housings 9630, a display portion 9631, operation keys 9632, a solar battery 9633, and a charge and discharge control circuit 9634. The electronic book reader illustrated in FIG. 10A has a function of displaying various kinds of information (e.g., a still image, a moving image, and a text image) on the display portion, a function of displaying a calendar, a date, the time, or the like on the display portion, a function of operating or editing the data displayed on the display portion, a function of controlling processing by various kinds of software (programs), and the like. FIG. 10A illustrates a structure including a battery 9635 and a DCDC converter (hereinafter abbreviated as a converter 9636) as an example of the charge and discharge control circuit 9634.

With the structure illustrated in FIG. 10A, in the case where a transflective liquid crystal display device be used as the display portion 9631, use under a relatively bright condition is assumed, which is preferable in that power generation with the solar battery 9633 and electrical charge with the battery 9635 can be performed with efficient. Note that a structure in which the solar battery 9633 is provided on each of a surface and a rear surface of the housing 9630 is preferable in order to charge the battery 9635 efficiently. A lithium ion battery may be used as the battery 9635, which brings an advantage of downsizing or the like.

Figure 10B:
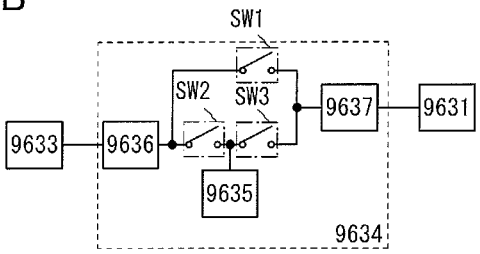

The structure and the operation of the charge and discharge control circuit 9634 illustrated in FIG. 10A are described with reference to a block diagram in FIG. 10B. The solar battery 9633, the battery 9635, the converter 9636, the converter 9637, switches SW1 to SW3, and the display portion 9631 are shown in FIG. 10B, and the battery 9635, the converter 9636, the converter 9637, and the switches SW1 to SW3 are included in the charge and discharge control circuit 9634.

First, an example of operation in the case where power is generated with the solar battery 9633 using external light is described. The power generated with the solar battery is raised or lowered by the converter 9636 so that the power has voltage for charging the battery 9635. Then, when the power from the solar battery 9633 is used for the operation of the display portion 9631, the switch SW1 is turned on and the voltage of the power is raised or lowered by the converter 9637 to voltage needed for the display portion 9631. In addition, when display on the display portion 9631 is not performed, the switch SW1 may be turned off and the switch SW2 may be turned on so that electrical charge of the battery 9635 is performed.

Next, operation in the case where power is not generated with the solar battery 9633 using external light is described. The power accumulated in the battery 9635 is raised or lowered by the converter 9637 by turning on the switch SW3. Then, power from the battery 9635 is used for the operation of the display portion 9631.

Note that although the solar battery 9633 is described as an example of a means for electrical charge, the battery 9635 may be charged with another means. A combination of the solar battery 9633 and another means for electrical charge may be used.

Embodiment 5 can be implemented in appropriate combination with any other structure described in the other embodiments.

This application is based on Japanese Patent Application serial No. 2010-010186 filed with Japan Patent Office on Jan. 20, 2010, the entire contents of which are hereby incorporated by reference.

EXPLANATION OF REFERENCE

60; operation mode selection mode: 61; data input: 62; extension discrimination: 63; standard or simple play?: 64; standard play mode: 65; simple play mode: 66; still image mode: 100; display device: 110; image processing circuit: 113; display control circuit: 116; memory circuit: 117; separation circuit: 119; decoder: 120; display panel: 121; driver circuit portion: 121A; gate line driver circuit: 121B; signal line driver circuit: 122; pixel portion: 123; pixel: 124; gate line: 125; signal line: 126; terminal portion: 126A; terminal: 126B; terminal: 127; switching element: 128; common electrode portion: 130; lighting unit: 210; capacitor: 214; transistor: 215; display element: 301; period: 302; period: 303; period: 304; period: 400; substrate: 401; gate electrode layer: 402; gate insulating layer: 403; oxide semiconductor layer: 405*a*; source electrode layer: 405*b*; drain electrode layer: 407; insulating layer: 409; protective insulating layer: 410; transistor: 420; transistor: 427; insulating layer: 430; transistor: 436*a*; wiring layer: 436*b*; wiring layer: 437; insulating layer: 440; transistor: 450; nitrogen atmosphere: 505; substrate: 506; protective insulating layer: 507; gate insulating layer: 510; transistor: 511; gate electrode layer: 515*a*; source electrode layer: 515*b*; drain electrode layer: 516; insulating layer: 530; oxide semiconductor film: 531; oxide semiconductor layer: 601; period: 602; period: 603; period: 604; period: 9630; housing: 9631; display portion: 9632; operation key: 9633; solar battery: 9634; charge and discharge control circuit: 9635; battery: 9636; converter: 9637; converter

The invention claimed is:

1. A display method of a display device, the display device comprising:

a memory circuit configured to store a digital data file;

a separation circuit configured to select a display mode in accordance with data which is provided by the digital data file and a value which is input into the separation circuit from an external, wherein the data is correlated to the display mode;

a display control circuit operationally connected to the separation circuit, wherein, when the digital data file includes a reference frame, the separation circuit is configured to separate the reference frame, decode the reference frame to create an image of one frame, and output the image of one frame to the display control circuit; and a display panel operationally connected to the display control circuit, the display panel comprising a pixel which includes a pixel electrode and a switching element, wherein the display mode is selected from among at least a standard play mode, a simple play mode, and a still image mode, wherein the switching element comprises an oxide semiconductor layer which includes a channel formation region, and wherein an off state current of the switching element per micrometer in a channel width at room temperature is less than or equal to $1\times10^{-17}$ A.

2. The display method of a display device according to claim 1, wherein the data is an extension of the digital data file.

3. The display method of a display device according to claim 1, wherein the data is a script of the digital data file.

4. The display method of a display device according to claim 1, wherein the data is a header of the digital data file.

5. The display method of a display device according to claim 1, wherein a carrier concentration of the oxide semiconductor layer is $1\times10^{14}/cm^3$ or less.

6. A display device comprising:

a display panel; and an image processing circuit, wherein the display panel includes a plurality of pixels, each of the pixels being connected to a scan line and a signal line and comprising a transistor and a pixel electrode connected to the transistor, the pixel electrode controlling an alignment of liquid crystals, wherein the image processing circuit includes a memory circuit configured to hold data which is provided by a digital data file and is correlated to an operation of the display device and a display control circuit configured to output an image signal and a control signal to the display panel in accordance with the data, wherein the image signal is formed by selecting one from a standard play mode, a simple play mode, and a still image mode, and wherein reference frames among frames are decoded in the simple play mode, and wherein an off state current of the transistor per micrometer in a channel width at room temperature is less than or equal to $1\times10^{-17}$ A.

7. An electronic device comprising the display device according to claim 6, wherein the electronic device is selected from the group consisting of an electronic book reader and a solar battery.

8. A display device comprising:

a memory circuit configured to store a digital data file;

a separation circuit configured to select a display mode from among at least a standard play mode, a simple play mode, and a still image mode;

a display control circuit operationally connected to the separation circuit, wherein, when the digital data file includes a reference frame, the separation circuit is configured to separate the reference frame, decode the reference frame to create an image of one frame, and output the image of one frame to the display control circuit;

a decoder operationally connected to the separation circuit, wherein the separation circuit is configured to output the digital data file to the decoder or the display control circuit in accordance with the display mode; and a display panel operationally connected to the display control circuit and the decoder, the display panel comprising a pixel which includes a pixel electrode and a switching element, wherein the switching element comprises an oxide semiconductor layer which includes a channel formation region, and wherein an off state current of the switching element per micrometer in a channel width at room temperature is less than or equal to $1\times10^{-17}$ A.

9. The display device according to claim 8, wherein, when the digital data file includes a reference frame, the separation circuit is configured to separate the reference frame, decode the reference frame to create an image of one frame, and output the image of one frame to the display control circuit.

* * * * *